US005377634A

United States Patent [19]

Taue

[11] Patent Number: 5,377,634

[45] Date of Patent: Jan. 3, 1995

[54] COMPRESSOR SYSTEM FOR RECIPROCATING MACHINE

[75] Inventor: Hun Taue, Iwata, Japan

[73] Assignee: Yamaha Hatsudoki Kabushiki Kaisha, Iwata, Japan

[21] Appl. No.: 114,464

[22] Filed: Aug. 31, 1993

[30] Foreign Application Priority Data

Sep. 8, 1992 [JP] Japan ..... 4-264157
Jan. 18, 1993 [JP] Japan ..... 5-21688

[51] Int. Cl.[6] ..... F02B 75/02
[52] U.S. Cl. ..... 123/317; 123/197.3
[58] Field of Search ..... 123/73 R, 73 V, 197.3, 123/197.4, 317

[56] References Cited

U.S. PATENT DOCUMENTS

| | | | |
|---|---|---|---|
| 1,812,566 | 6/1931 | Spencer | 123/41.13 |
| 3,123,059 | 3/1964 | Casini | 123/73 R |
| 3,402,705 | 9/1968 | Stevenson | 123/73 V |
| 3,695,150 | 10/1972 | Salzmann | 123/197.3 |
| 4,088,097 | 5/1978 | Litz | 123/73 AA |
| 4,545,346 | 10/1985 | Grow | 123/305 |
| 5,105,775 | 4/1992 | Maissant | 123/73 V |

FOREIGN PATENT DOCUMENTS

| | | |
|---|---|---|
| 1019505 | 11/1957 | Germany . |
| 2136513 | 5/1990 | Japan . |
| 649016 | 1/1951 | United Kingdom . |
| 2254884 | 10/1992 | United Kingdom . |

OTHER PUBLICATIONS

European Search Report dated Nov. 29, 1993.

*Primary Examiner*—Noah P. Kamen
*Attorney, Agent, or Firm*—Knobbe, Martens, Olson & Bear

[57] ABSTRACT

Two embodiments of reciprocating machines such as four cycle, internal combustion engines wherein the piston, connecting rod, crankshaft and crankcase are interrelated in such a way so as to function as a positive displacement compressor. The connecting rod serves as a valving element for the intake passage to the crankcase chamber and in one embodiment, the crankshaft functions as the valving member for the discharge passage from the crankcase chamber. An embodiment that permits pressure control by bypassing the compressed charge back to the intake passage is also described.

48 Claims, 19 Drawing Sheets

COMPRESSOR SYSTEM FOR RECIPROCATING MACHINE

BACKGROUND OF THE INVENTION

This invention relates to a compressor system for a reciprocating machine and more particularly to an improved positive displacement crankcase compression device for such a machine.

En many types of reciprocating machines, such as internal combustion engines, it has been proposed to employ the variable volume of the crankcase chamber as the piston reciprocates as a device for supercharging or pressuring the intake charge. When this concept is applied to four cycle engines, it is possible to obtain two supercharging strokes for each firing of the engine.

However, even though the crankcase is used as a compressing device, the actual increase in output of the engine has been only slight. The reason for this is because of the large volume of the crankcase chamber which does not act to provide any compression and also the drop of charging efficiency caused by the heating of the compressed mixture by the engine. In order to increase the supercharging effect, it is necessary to reduce the dead volume in the crankcase chamber. This is done to increase the compression ratio which compression ratio is obtained by dividing the sum of the crankcase volume $V_c$ when the piston is at its bottom dead center position and the stroke $V_h$ caused by the change in volume when the piston moves to its top dead center position. This is similar to the manner in determining the compression ratio of the engine on the piston side. Since a large percentage of the volume of the crankcase is occupied between the webs of the crankshaft, it is difficult to reduce the crankcase volume $V_c$.

It has been proposed to provide a positive type displacement arrangement in the crankcase chamber so as to operate like a rotary type vacuum pump. When this has been done, however, a rotor has been slideably supported within the crankcase chamber and is driven by the crankshaft so as to act as a pump. However, this provides quite a complicated structure.

It is, therefore, a principal object to this invention to provide an improved positive displacement, crankcase compression system for a reciprocating machine that employs only the crankshaft and connecting rod as the compressor elements.

It is a further object to this invention to provide an improved crankcase compressor for a reciprocating machine.

In addition to the difficulties as aforenoted, it has also been the practice to employ reed type check valves both in the admission system for the air to the crankcase chamber that will be compressed and also on the discharge side of the crankcase compressor. The use of such reed type valves gives a flow resistance to the charge which decreases the pumping efficiency and also does not permit control of the timing when the respective ports are opened and closed.

It is, therefore, a still further object to this invention to provide an improved valving arrangement for a compressor of this type.

It is a further object to this invention to provide a valving arrangement for a compressor within the crankcase of a reciprocating machine that employs the actual components of the machine as the valving elements.

SUMMARY OF THE INVENTION

A first feature of this invention is adapted to be embodied in a reciprocating machine that is comprised of a cylinder having a cylinder bore with a crankcase chamber formed at one end thereof. A piston reciprocates in the cylinder bore and a crankshaft is rotatably journalled in the crankcase chamber. A connecting rod couples the piston and the crankshaft for transmitting motion therebetween. The connecting rod has a portion thereon which is in sealing engagement with the crankcase during at least a portion of a single rotation of the crankcase for acting as a positive displacement pump. Means admit an air charge to the crankcase chamber at one area and means discharge a compressed charge from the crankcase at another area spaced from the one area.

Another feature of the invention is adapted to be embodied in a port control arrangement for a reciprocating machine that is comprised of a cylinder defining a cylinder bore in which a piston is supported for reciprocation. A crankcase chamber is formed at one end of the cylinder bore and a crankshaft is journalled for rotation in the crankcase chamber. A connecting rod is connected to the piston at one end and is journalled at the other end on the crankshaft for transmitting motion between the crankshaft and the piston. Means define a port in the crankcase chamber and one of the connecting rod and crankshaft are configured so as to sequentially open and close the communication of the port with the crankcase chamber upon rotation of the crankshaft.

In accordance with one facet of the invention described in the preceding paragraph, the connecting rod functions as the port opening and closing member and in accordance with another facet of the invention, the crankshaft itself functions as the opening and closing member.

BRIEF DESCRIPTION OF THE DRAWINGS

FIG. 7 shows 45° of crankshaft rotation.

FIG. 8 shows 90° of crankshaft rotation.

FIG. 9 shows 135° of crankshaft rotation.

FIG. 10 shows 180° of crankshaft rotation (T.D.C.).

FIG. 11 shows 225° of crankshaft rotation.

FIG. 12 shows 270° of crankshaft rotation.

FIG. 13 shows 315° of crankshaft rotation.

FIG. 19 shows bottom dead center (B.D.C.).

FIG. 20 shows 45° of rotation from bottom dead center.

FIG. 21 shows 90° of rotation from bottom dead center.

FIG. 22 shows 135° of rotation.

FIG. 23 shows 180° of rotation (T.D.C.).

FIG. 24 shows 225° of rotation.

FIG. 25 shows 270° of rotation.

FIG. 26 shows 315° of rotation.

DETAILED DESCRIPTION OF THE PREFERRED EMBODIMENTS OF THE INVENTION

Figure 1:
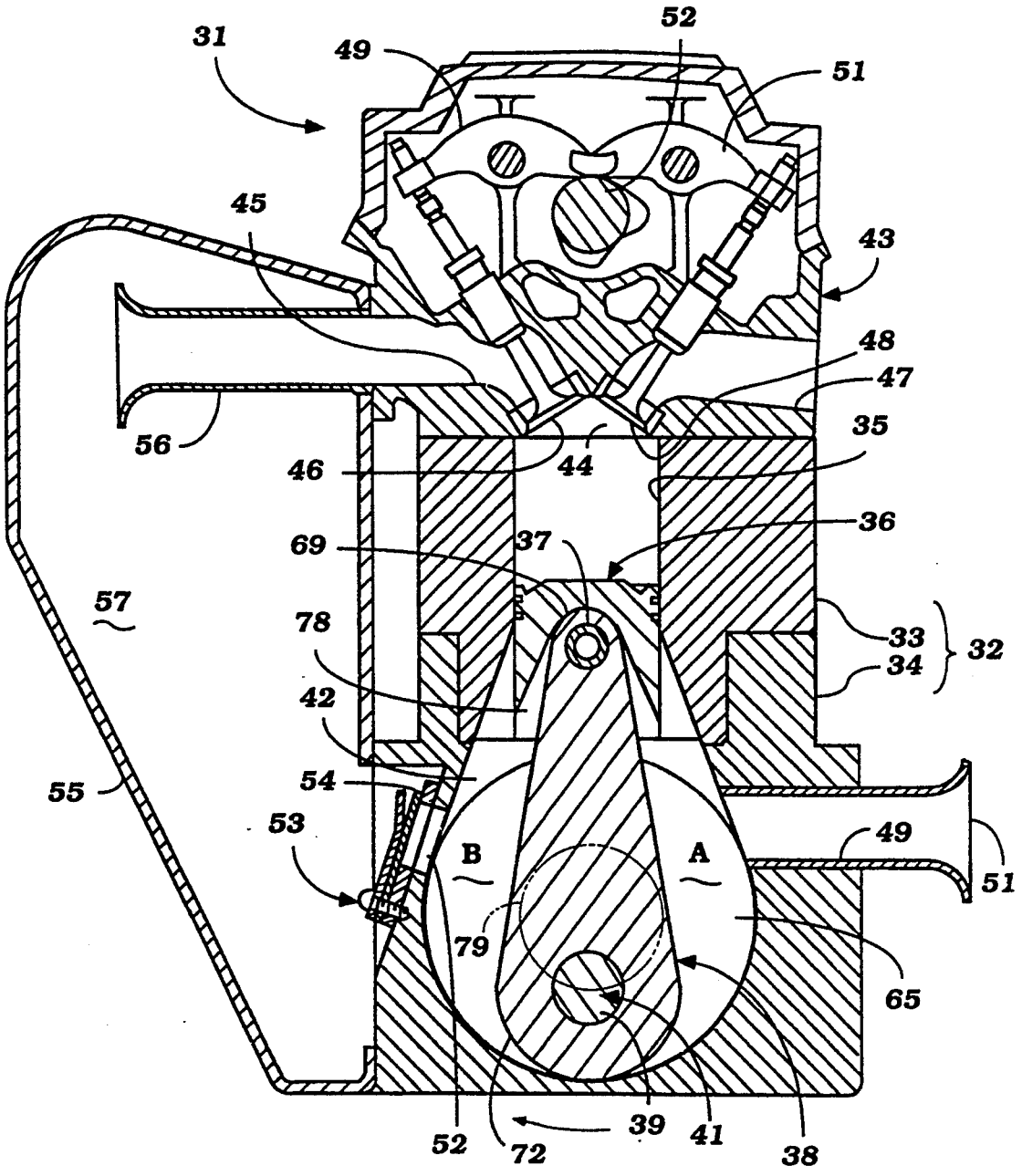
FIG. 1 is a cross sectional view taken through a single cylinder of a four cycle internal combustion engine constructed in accordance with an embodiment of the invention.

Referring now in detail to the drawings and initially to the embodiment of FIGS. 1 through 13, a four cycle internal combustion engine constructed in accordance with this embodiment is identified generally by the reference numeral 31. The engine 31 may be of any known configuration such as an in-line engine, a V-type engine or an opposed engine and may have any number of cylinders. Since it should be obvious to those skilled in the art how the invention may be employed with multiple cylinder engines having any of these types of configurations, only a single cylinder of the engine 31 has been illustrated. Also, although the invention is described in conjunction with a four cycle internal combustion engine, it is to be understood that facets of the invention may be employed with engines operating on other principals such as two stroke engines and also that certain facets of the invention may be utilized with other types of reciprocating machines such as compressors or the like.

Referring primarily to FIG. 1, the engine 31 is provided with a cylinder block crankcase assembly, indicated generally by the reference numeral 32 and comprised of a cylinder block 33 and a crankcase 34 that are fixed to each other in any suitable manner or which may be formed as a unitary assembly if desired. The cylinder block 33 is provided with one or more cylinder bores 35 in which pistons 36 reciprocate. The configuration of the pistons 36 will be described in more detail later by reference to FIG. 5. The piston 36 has pivotal connections by means of a piston pin 37 to the small end of a connecting rod 38. The configuration of the connecting rod 38 will be described later by particular reference to FIG. 4.

The big ends of the connecting rod 38 are journalled on the throws or crank pins 39 of a crankshaft, indicated generally by the reference numeral 41 and having a configuration as will be described later by particular reference to FIG. 3. The crankshaft 41 is rotatably journalled within a crankcase chamber 42 which is formed in the crankcase member 34 and which has a configuration as will be described later by particular reference to FIG. 2. If the engine is of a multi-cylinder type, each crankcase chamber 42 will be preferably sealed from the others and the manner in which that can be done will be readily apparent when the construction of the crankshaft 41 is described later.

A cylinder head assembly, indicated generally by the reference numeral 43 is affixed to the cylinder block 33 in any well known manner. The cylinder head 43 has a recesses 44 formed in its lower surface which recess along with the cylinder bore 35 and the head of the piston 36 forms the individual combustion chambers of the engine 31.

An intake passage 45 extends through one side of the cylinder head 43 and terminates at a valve seat which is controlled by an intake valve 46. In a similar manner, an exhaust passage 47 extends through the opposite side of the cylinder head 43 and terminates in a valve seat that is controlled by an exhaust valve 48. In the illustrated embodiment, the intake and exhaust valves 46 and 48 are operated by respective rocker arms 49 and 51 which, in turn, are controlled by a single overhead camshaft 52 that is journalled for rotation in the cylinder head 43 in a known manner. the camshaft 52 is driven from the crankshaft 41 by a drive mechanism am one half crankshaft speed, as is well known in this art. It should be noted that the drawings do not show all of the components associated with the intake and exhaust valves 46 and 48 such as the valve springs, et cetera because those constructions are conventional and those skilled in the art will readily understand the valve actuation and how this can be accomplished.

As has already been noted, an important feature of this invention is the way in which the crankcase chamber 42, connecting rod 38 and crankshaft 41 are configured so as to cooperate with the piston 36 and act as a positive displacement air compressor or supercharger. To the end, an intake passage 49 is formed in the crankcase 34 and opens into the crankcase chamber 42 in a manner which is be described in more detail later by reference to FIG. 2. The intake passage 49 has an inlet end 51 that may cooperate with an air filter and air silencer or other type of air inlet device (not shown). The air which is drawn into the crankcase chamber 42 will be compressed in the manner to be described and the compressed charge is delivered to a discharge port 52 formed in the crankcase member 34 on the side opposite to the intake passage 49. A reed type check valve 53 has a valve element 54 which will open when the charge is pressurized and permit the charge to be delivered to an accumulator chamber 55 that is affixed in sealing relationship to the intake side of the engine and specifically the crankcase member 34, cylinder block 33 and cylinder head 43. The cylinder head intake passage 45 is provided with an inlet trumpet 56 that extends into the volume 57 of the plenum chamber 55 so that a compressed charge delivered thereto may flow into the combustion chamber recess 44 when the intake valve 46 is opened.

The construction of the cylinder block crankcase assembly 32, crankshaft 41, connecting rod 38 and piston 36 which permits this positive displacement compressor to be formed will now be described by particular reference to FIGS. 2 through 5 for each component with the assembly being shown in more detail in FIG. 6.

Figure 2:
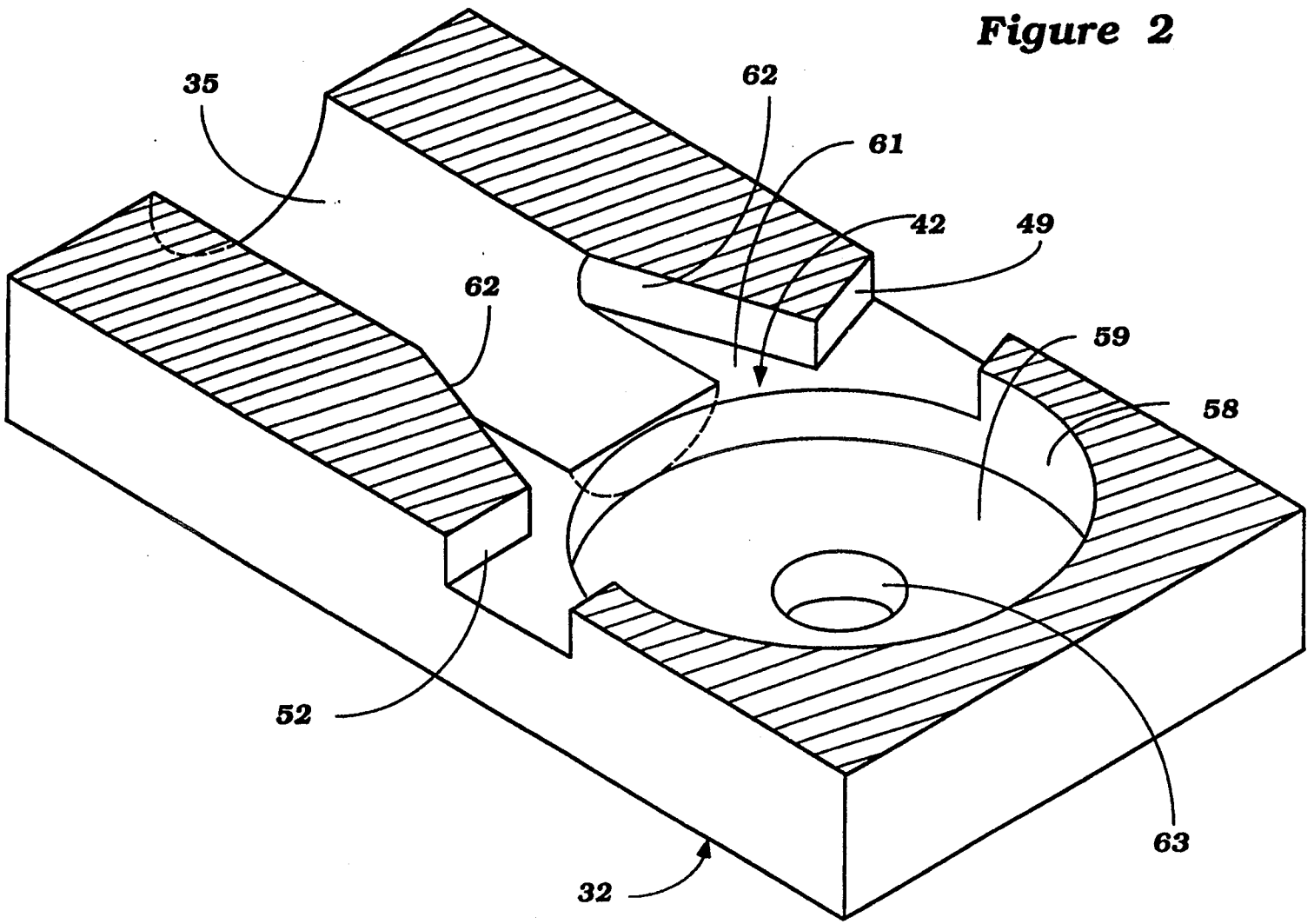
FIG. 2 is an enlarged perspective view, shown in cross section, of the cylinder block crankcase assembly showing the configuration of the sealing surfaces.
Figure 3:
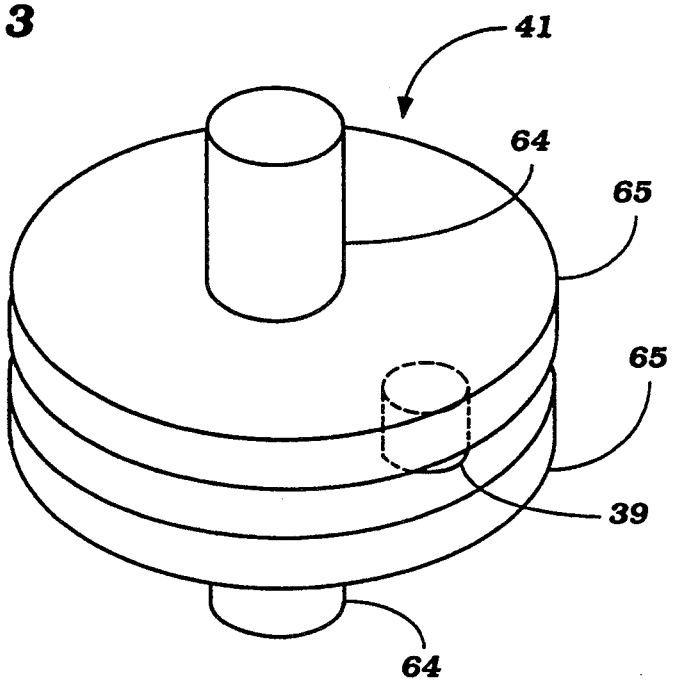
FIG. 3 is an enlarged perspective view of the crankshaft.
Figure 4:
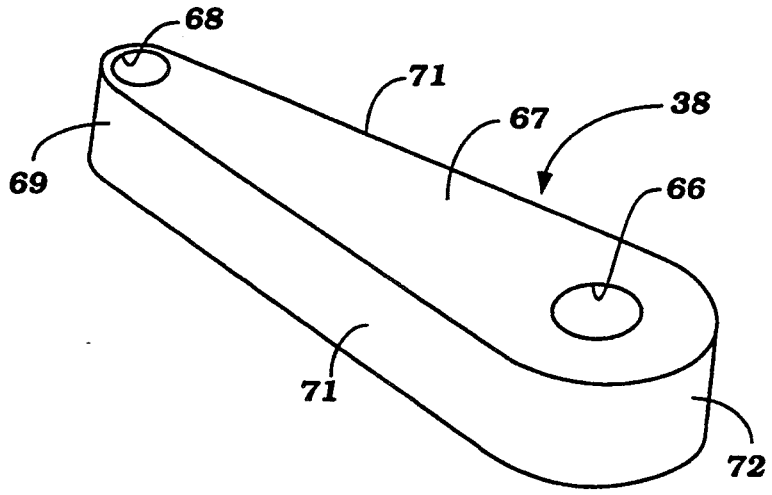
FIG. 4 is an enlarged perspective view of the connecting rod.

Referring first to FIG. 2, it should be noted that the crankcase chamber 42 is formed from a first generally cylindrical surface 58 that has a diameter which is slightly larger than the disc portions of the crankshaft 41 which will be described. A pair of end surfaces 59 define the opposite sides of the cylindrical portion 58 and the relationship of the intake port 49 and the exhaust or discharge port 52 are readily seen in this figure. It should be noted that the chamber 42 also includes a flattened section defined by a pair of facing surfaces 61 which have a spacing from each other that is substantially equal to the thickness of the connecting rod 38, for a reason to be described. A pair of angular related surfaces 62 provide clearance for the connecting rod 38 and merge into the cylinder bore 35 as clearly shown in the drawings.

A cylindrical bore 63 is formed at opposite sides of the cylinder block crankcase 32 in the surfaces 59 and form the main bearings for the crankshaft 41, the construction of which will now be described by reference to FIG. 3.

The crankshaft 41 has a pair of main bearing portions 64 that are rotatably journalled in the cylinder block crankcase member bores 63 and separate removable bearing inserts or anti-friction bearings may be employed. In order to seal one crankcase chamber from the other, suitable seals may also be fixed to the cylinder block crankcase member 32 and sealingly engage the main bearing portions 64.

Rather then the conventional throws, the crankshaft 41 is formed with a pair of disc-like portions 65 that have their end surfaces in close fitting relationship with the surfaces 59 of the cylinder block crankcase member 32 and their outer diameter substantially equal to the cylindrical surface 58 so as to provide not only a good seal but also so as to minimize the dead volume in the crankcase chambers 42 so as to improve the compression ratio of the crankcase compressor. The crank pin 39 extends between the inner surfaces of the disc portions 65 of the crankshaft 41 and receives a bearing 66 of the connecting rod which will now be described by reference to FIG. 4.

The connecting rod 38 has a configuration comprised of a pair of flat sides 67 which face the discs 66 and which also are in sliding engagement with the surfaces 61 of the cylinder block crankcase assembly 32 so as to provide a fluid Eight seal. The small end of the connecting rod 38 has a bore 68 that receives the piston pin 37 and also an arcuate bearing surface 69 which cooperates with the underside of the dome of the piston 36 in a manner which will be described by reference to FIG. 5.

A pair of side surfaces 71 extend from the arcuate surface 69 at the small end to a larger arcuate surface 72 at the big end of the connecting rod 38. The curved surface 72 at the big end of the connecting rod 38 is complimentary in configuration to the cylindrical part 58 of the cylinder block crankcase assembly 32 so as to provide sealing engagement therewith throughout a substantial portion of a single rotation of the crankshaft 41, as will be apparent from the description of the operation by reference to FIG. 1 and FIGS. 7 through 13.

Figure 5:
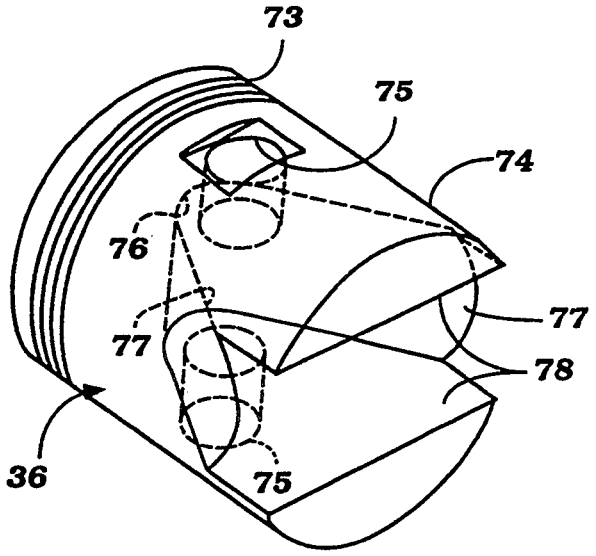
FIG. 5 is an enlarged perspective view of the piston.
Figure 6:
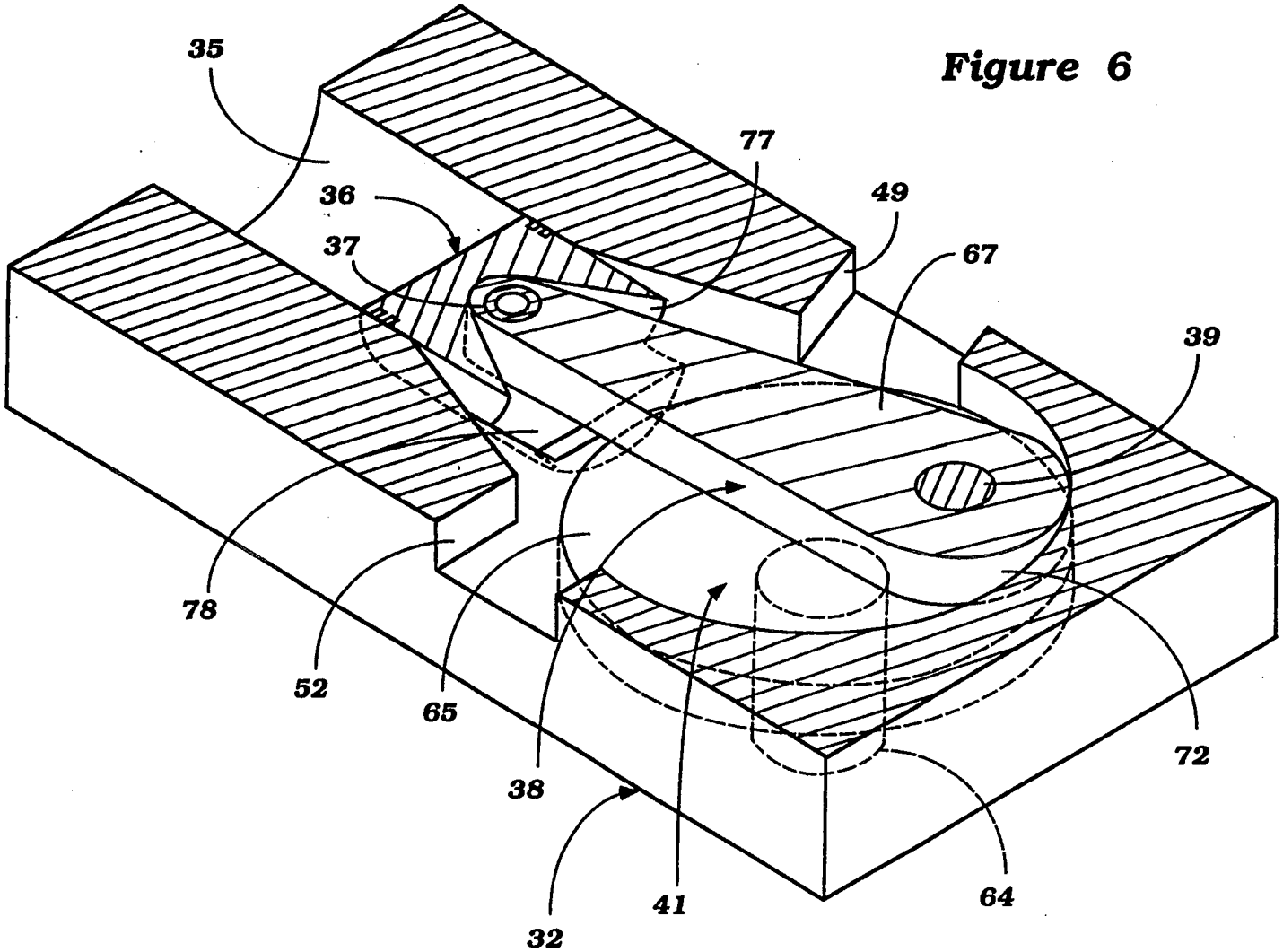
FIG. 6 is a view in part similar to FIG. 2 but shows the piston, connecting rod and crankshaft in position.

Referring now to FIG. 5, the piston 36 has conventional ring grooves 73 that receive piston rings (not shown) for sealing purposes with the cylinder bore 35 and a lower skirt portion 74. Piston pin bosses 75 are formed in this skirt portion and receive the piston pin 37 to provide the pivotal connection to the small end of the connecting rod 38.

The interior of the piston 36 is formed with an arcuate machined surface 76 that is complimentary to the curved surface 69 of the connecting rod 38 so as to provide a fluid tight seal in this area and also so as to reduce dead volume in the lower end of the engine 31. From the curved surface 76, the interior of the piston is formed with a pair of diverging surfaces 77 which cooperate with the sides of the connecting rod 38 and specifically the portion 71 so as to again reduce dead volume while still permitting the free movement of the connecting rod 38 relative to the piston 36 during the reciprocation of the piston 36.

Facing surfaces 78 complete the piston cavity and these surfaces are spaced apart a distance substantially equal to the distance between the connecting rod surfaces 67 so as to again provide a fluid tight seal. If desired, the sealing surfaces as thus far or some of them may be coated with a suitable friction reducing material that will also assist in sealing such as a resin impregnated or coated with fluorine in the same manner as applied to the rotors of Roots type superchargers.

The way in which the crankcase chambers 42 act to serve as an air compressor will now be described in conjunction with FIGS. 1 and 7 through 13 which show a single cycle of rotation beginning at the bottom dead center position of the piston 36 as shown in FIG. 1. This will be considered the reference position and in this position, the curved surface 72 of the connecting rod 38 will divide the crankcase chamber 42 into two portions, an intake portion A and a compression portion B. At bottom dead center position, it should be seen that the intake port 49 is fully opened and air may freely flow into the crankcase chamber 42 so long as the volume of the chamber A is increasing. As rotation continues from the bottom dead center position in a clockwise direction as shown by the arrow, the center of the crank pin 39 of the crankshaft 41 will travel in an arc indicating by the —.— (dash/dot/dash) line 79 in FIG. 1 and the piston 36 will begin to move upwardly while the volume of the intake chamber A increases and the volume of the compression chamber B decreases.

Figure 7:
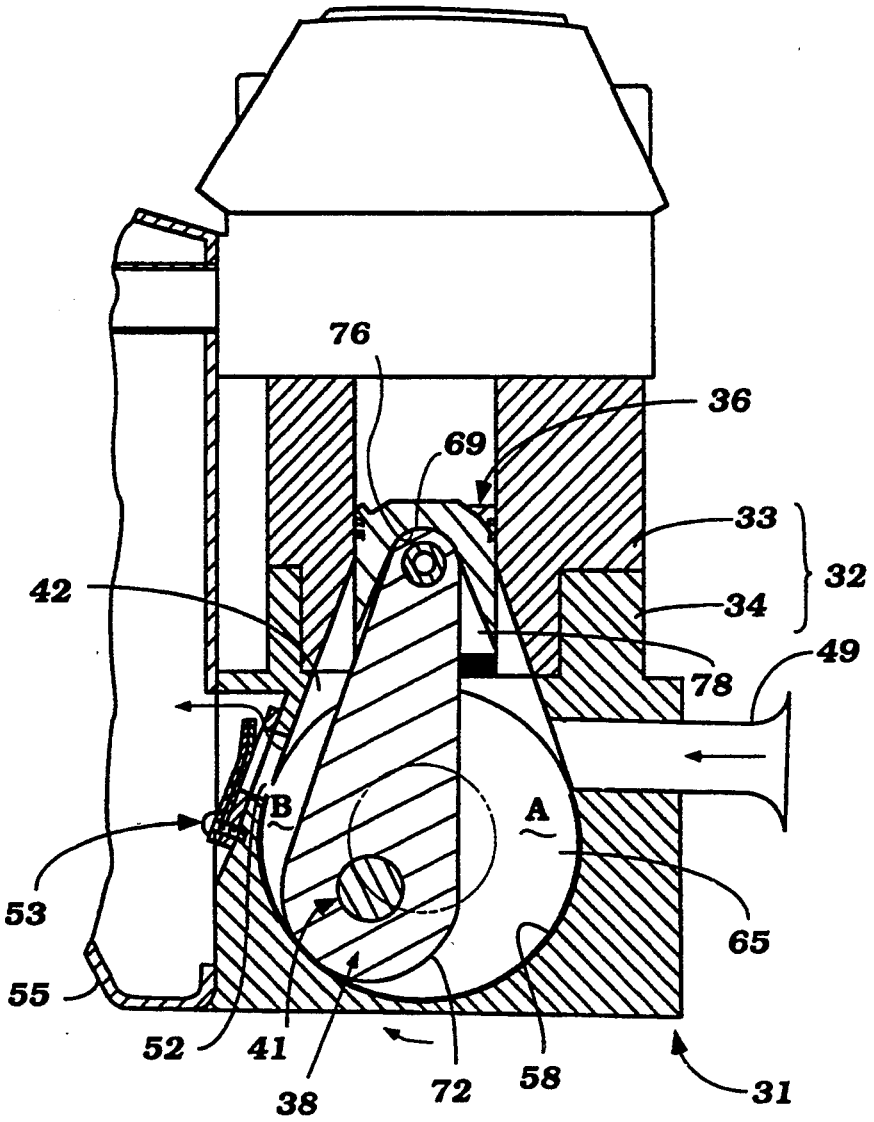
FIGS. 7 through 13 are sequential views, in part similar to FIG. 1, showing the sequence of operation during a single rotation of the crankshaft at various crank angles from bottom dead center as noted below.
Figure 8:
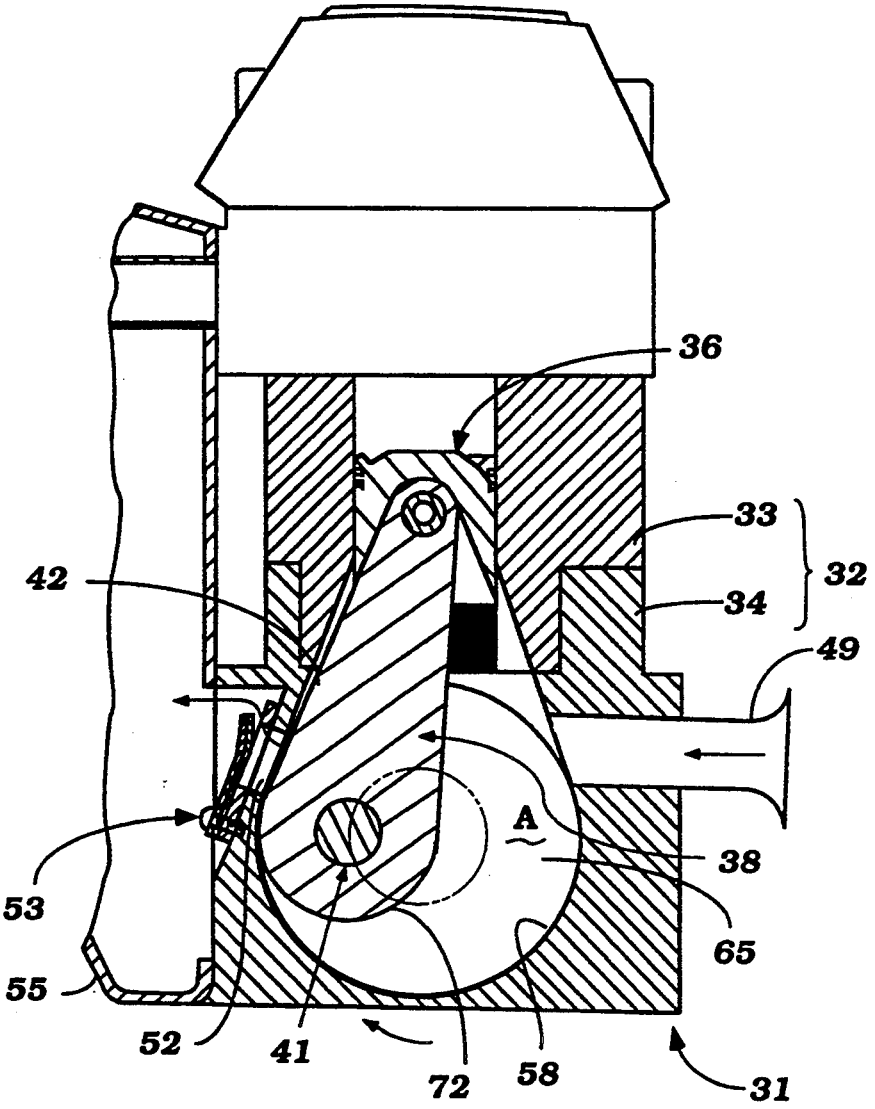
Figure 9:
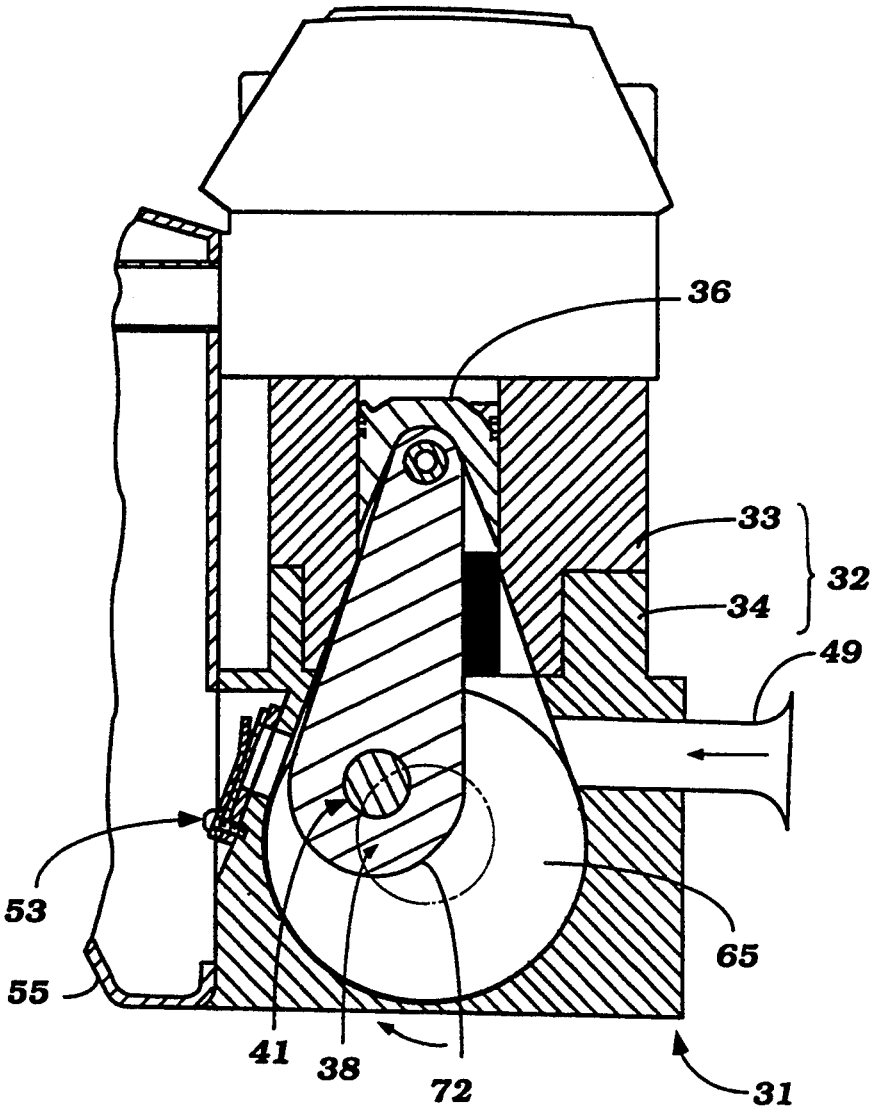

This increased volume of the intake chamber A causes air to be drawn into the chamber A from the atmosphere where the volume of air inducted during this degree of rotation is shown by the blackened portion of the lower end of the cylinder bore 35 in FIG. 7. It should be noted that the connecting rod surface 69 has a sealing relationship with the piston surface 76 during this rotation so that the chambers A and B are isolated from each other. This sealing is further accomplished by the cooperation of the side surfaces 67 of the connecting rod 38 with the crankshaft discs 65, the piston side surfaces 78 and the cylinder block surfaces 61.

When the charge in the chamber B is compressed as its volume decreases, sufficient pressure will be exerted on the reed type check valve 53 to cause it to open and this compressed charge will then be delivered into the accumulator chamber 55. During this time the intake valve 46 will be closed and a pressurized charge will build up in this chamber. It should be noted that this compression occurs both during the exhaust stroke and also the compression stroke of the engine. Thus, there will be two compression cycles for each firing cycle of the engine, as aforenoted.

Upon continued rotation (FIG. 8) the chamber A continues to increase in volume and more air will be inducted as shown by the blackened area in this figure while air will continue to be delivered under pressure to the accumulator chamber 55.

As the piston 36 continues to approach top dead center (FIG. 9) the connecting rod surface 72 will move away from the cylindrical surface of the crankcase and the chambers A and B will now openly communicate with each other. Air will continue to be inducted into the combined chamber under this condition with the volume being again shown by the blackened area.

If the piston 36 is on its compression stroke, sometime during this operating fuel will be admitted to the combustion chamber 44 and this may be either done by direct cylinder fuel injection or by port injection into the intake port 45. Also, at some point approaching top dead center the spark plug (not shown) of the engine will be fired.

Alternatively, if the upward movement of the piston 36 is on the exhaust stroke, then the exhaust valve 48 will be opened at some time during this operation and the exhaust charge will be delivered out of the exhaust passage 47 to an appropriate exhaust manifold (not shown). In this latter case pressure will be maintained in the accumulaot chamber 55 as long as the intake valve 46 is closed.

Figure 10:
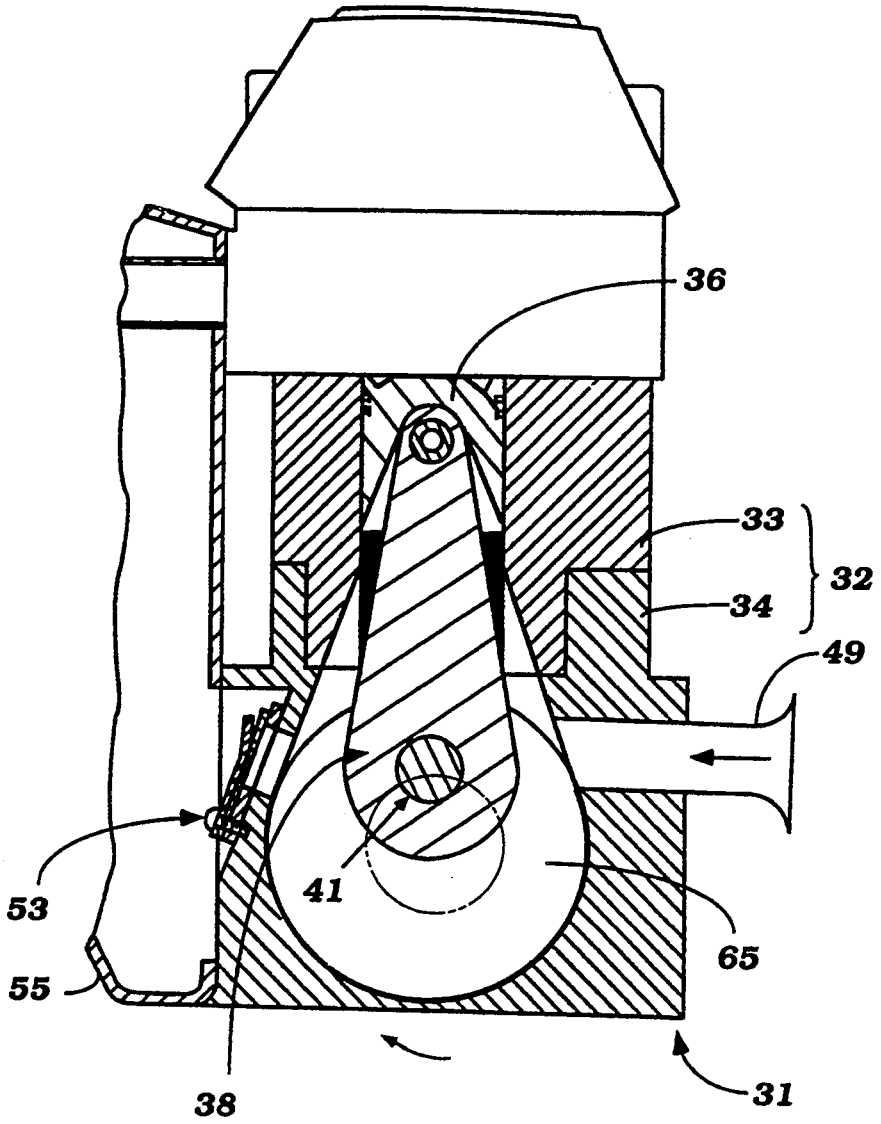
Figure 11:
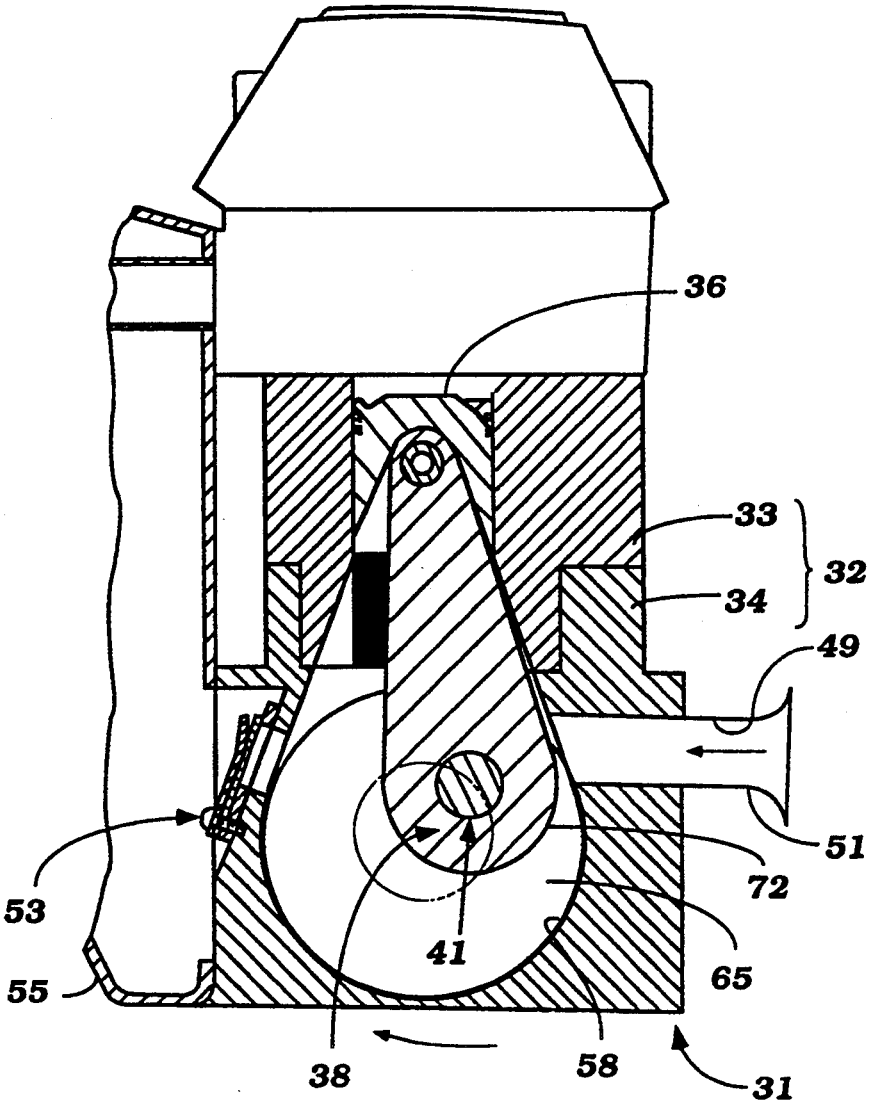

FIG. 10 shows the condition when the piston 36 is at top dead center and in this position there will cease to be any further charge drawn into the crankcase chamber 42 because of the difference of pressure.

As the piston 36 continues it downward movement (FIG. 11) the connecting rod side surfaces 71 will come into confronting relationship with the intake port 49 and close it so that the gases which are now being compressed will not flow out of the intake passage.

Figure 12:
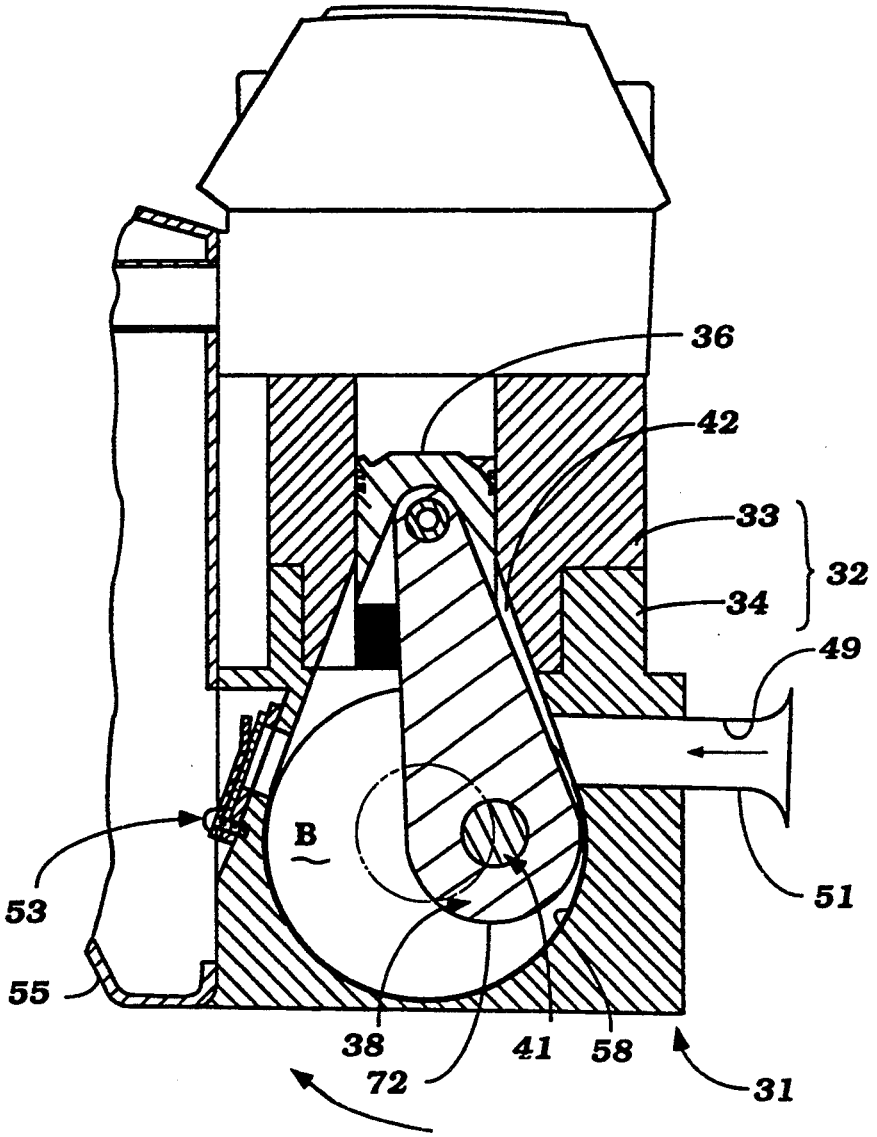
Figure 13:
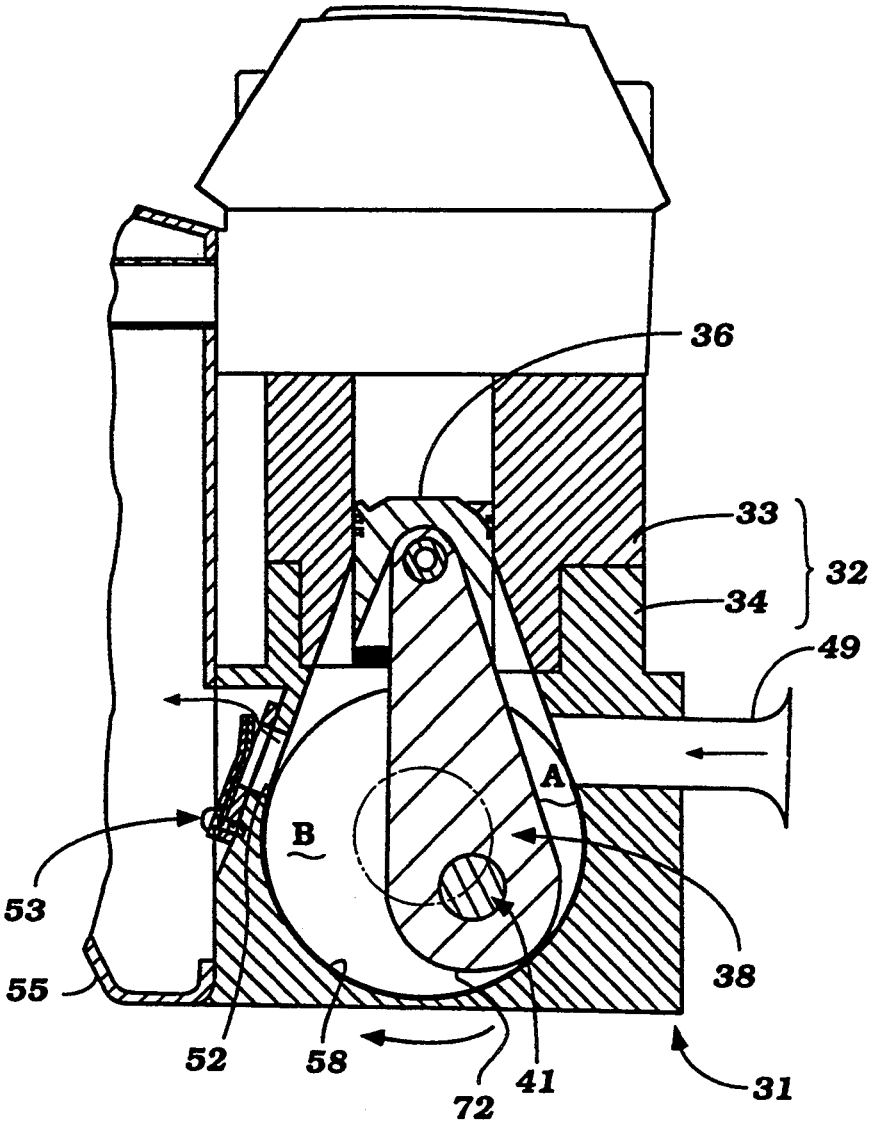
Figure 14:
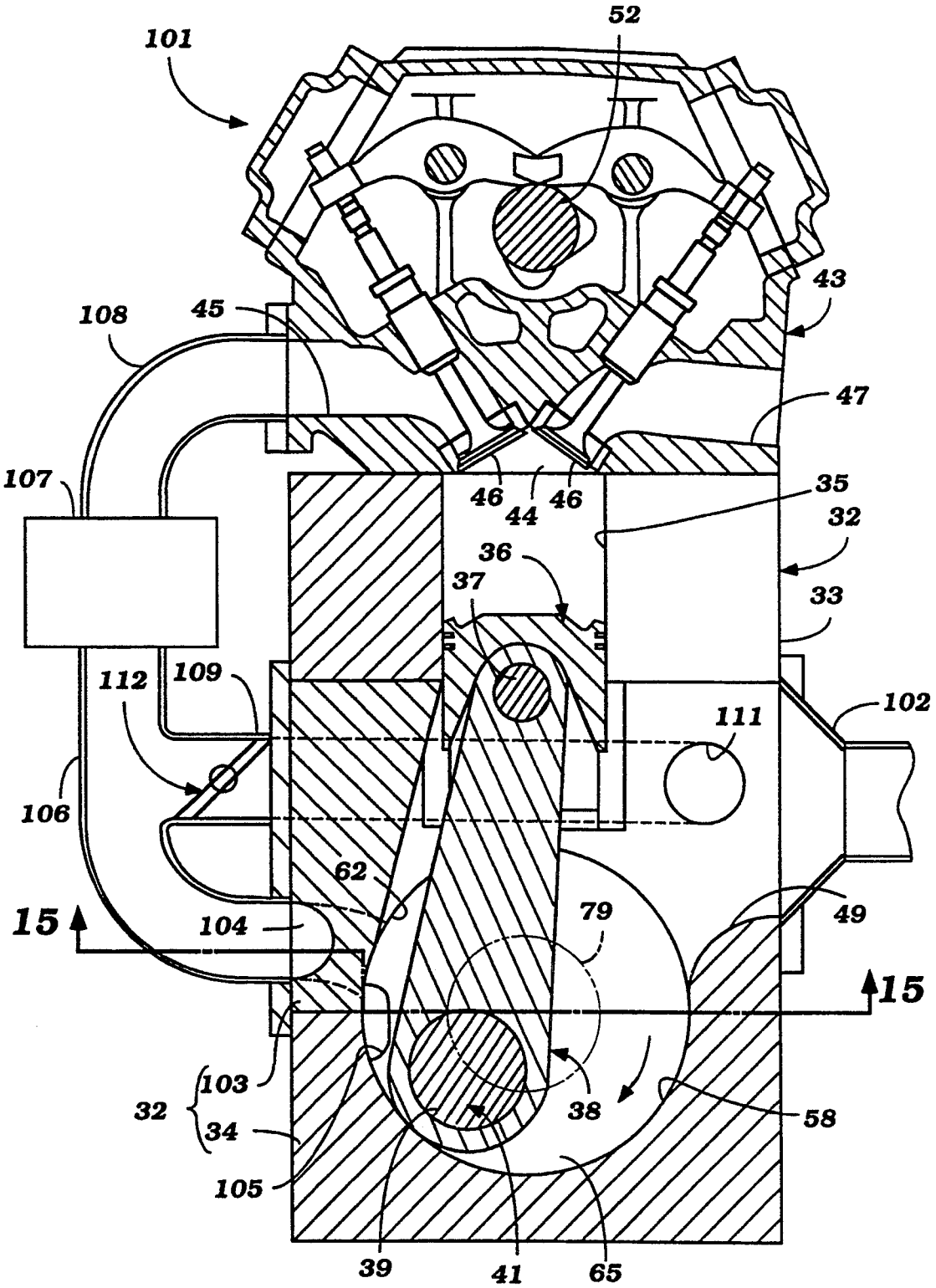
FIG. 14 is a cross sectional view, in part similar to FIG. 1, and shows another embodiment of the invention.
Figure 15:
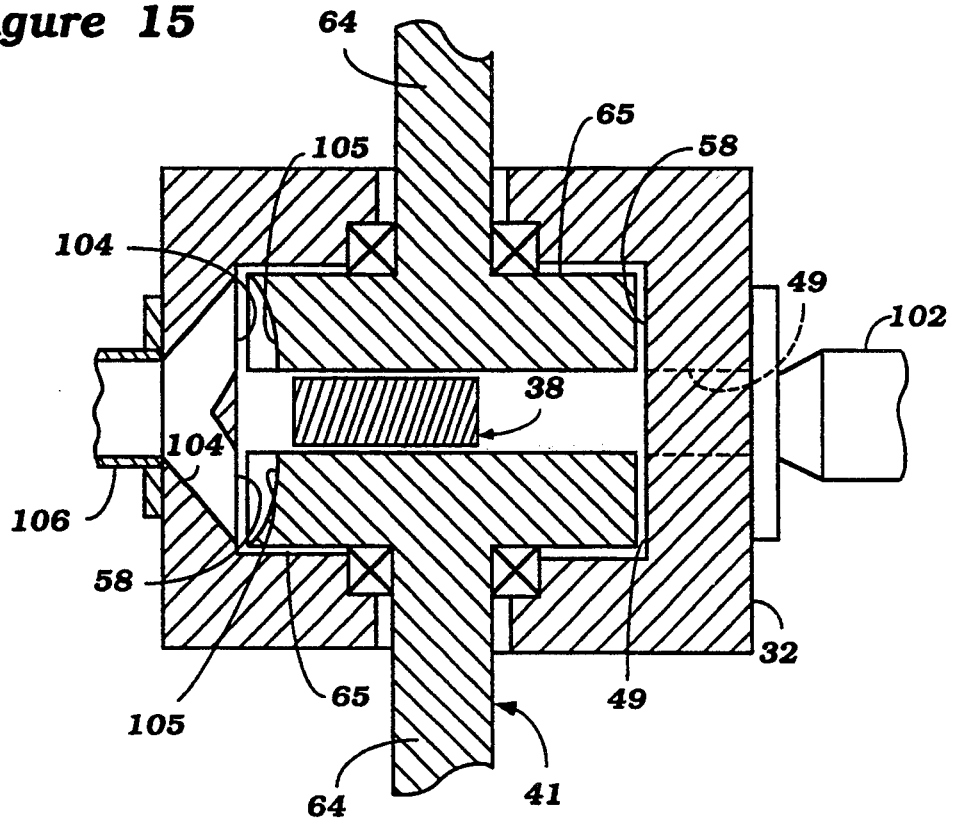
FIG. 15 is a cross sectional view taken along the line 15—15 of FIG. 14.
Figure 16:
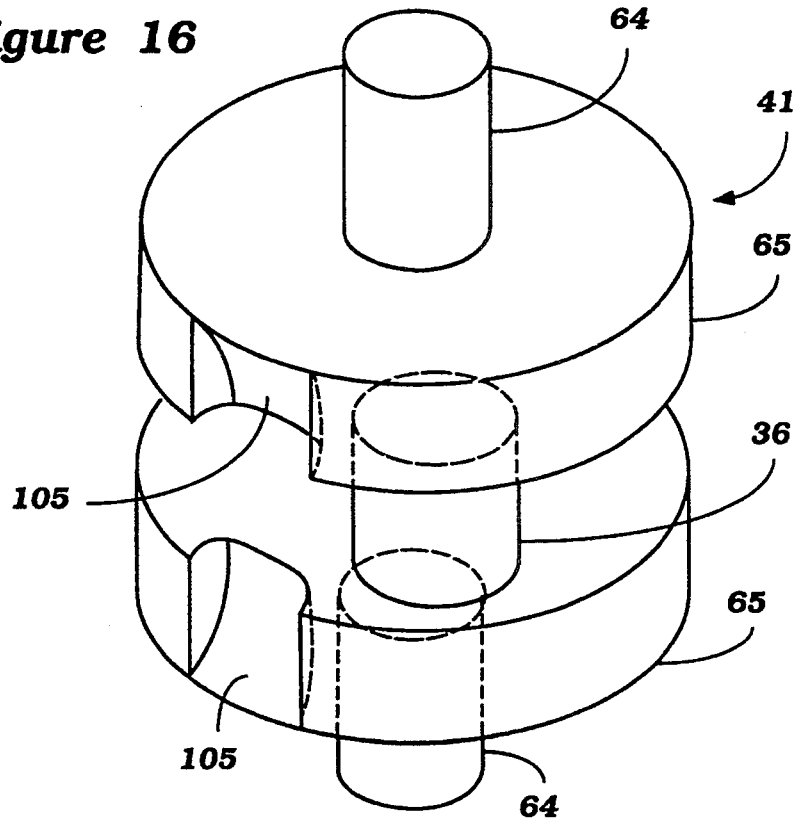
FIG. 16 is a perspective view, in part similar to FIG. 3, and shows the crankshaft for this embodiment.
Figure 17:
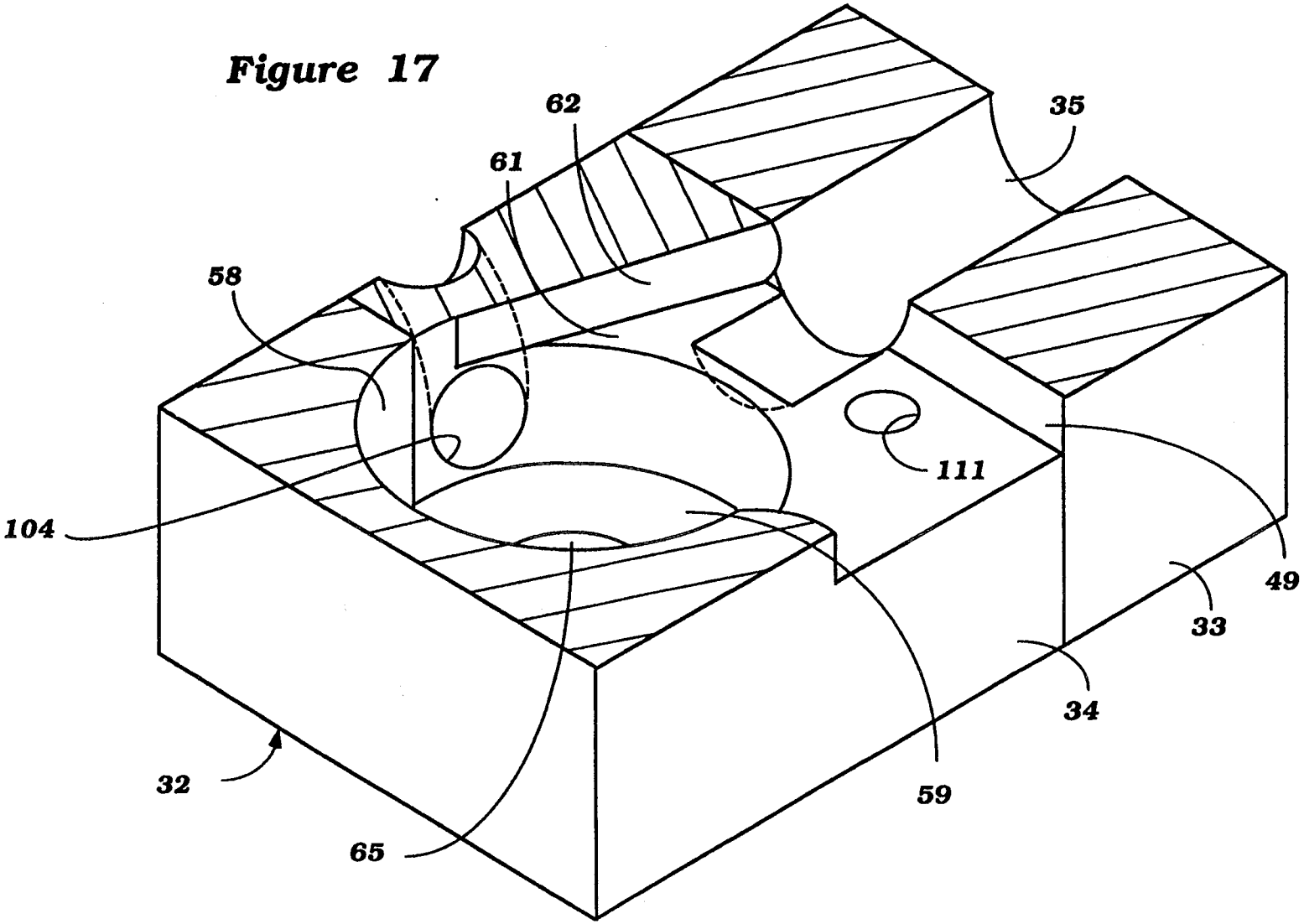
FIG. 17 is a perspective view, in part similar to FIG. 2, and shows the cylinder block crankcase assembly for this embodiment in cross section.
Figure 18:
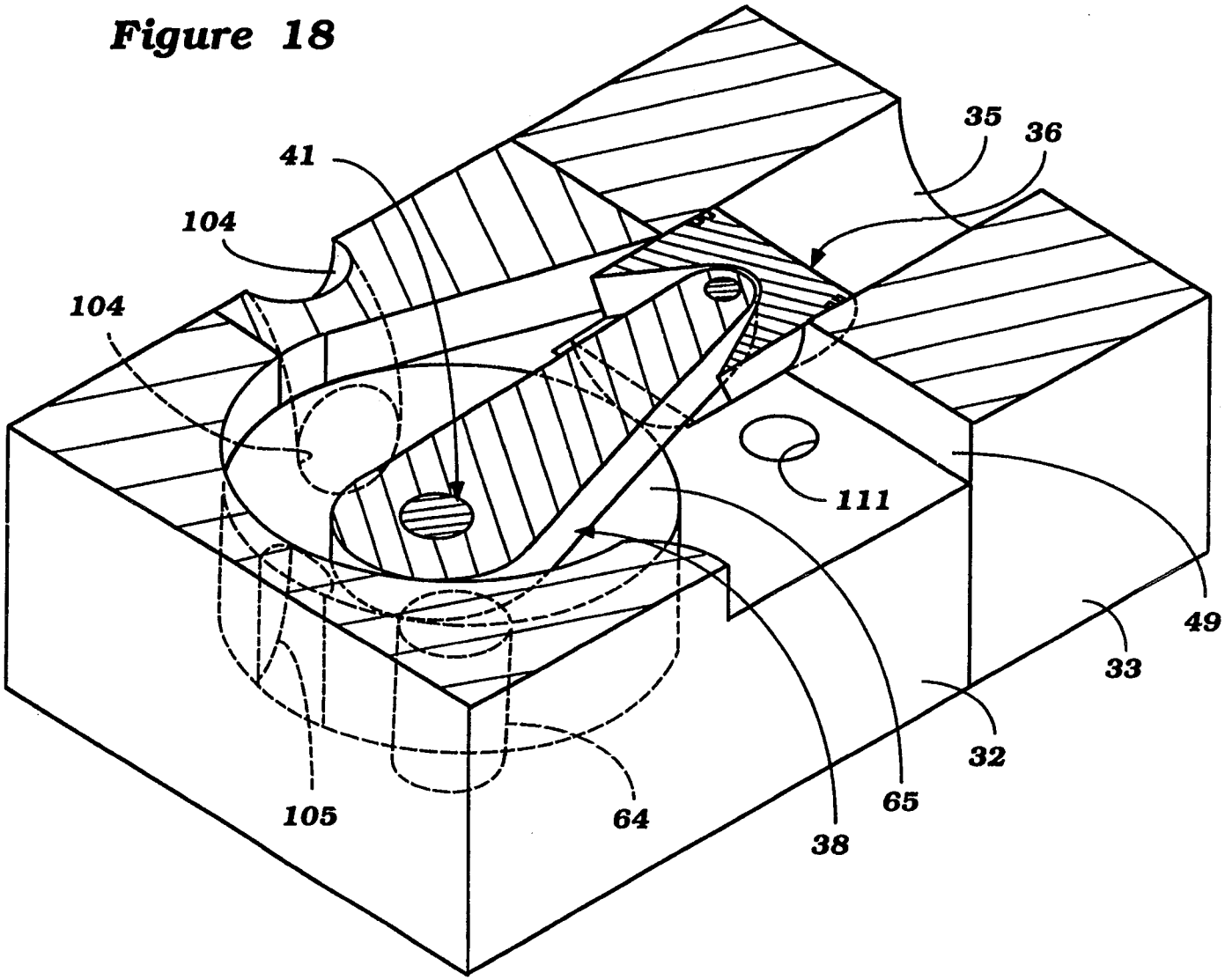
FIG. 18 is a perspective view, in part similar to FIG. 6, and shows the piston, connecting rod and crankshaft inserted into the cylinder block crankcase assembly as shown in FIG. 17.

Upon continued rotation, the connecting rod surface 72 will again engage the crankcase surface 58 and cause a seal to separate the chambers A and B again as shown in FIG. 12. After this time, the connecting rod side surfaces 71 will move away from the intake port 49 and it will be opened and further air charge can then be drawn into the now newly formed chamber A as shown in FIG. 13 while the charge trapped in chamber B will become compressed and delivered past the open reed valve 53 into the accumulator chamber 55.

Thus, it should be readily apparent that this construction provides very efficient compression within the crankcase chamber and requires no complicated mechanisms and in fact uses the basic components of a conventional engine reconfigured merely to accomplish the sealing desire. Also, the connecting rod side surfaces 71 themselves act as a valve for the intake port 49 so that no reed type valves and the pressure loss associated with them will be required.

Referring now to FIGS. 14 through 26, an internal combustion engine constructed in accordance with another embodiment is identified generally by the reference numeral 101. This embodiment, although many of the components are the same as the previously described embodiment, has several important differences. As will become apparent., in this embodiment not only is the use of the reed type check valve on the inlet side of the compressor eliminated, but also the use of the reed type valve 53 on the exhaust side of the compressor of the previous embodiment is eliminated by employing the crankshaft 41 itself as a valve. In addition, the accumulator chamber of the previously described embodiment is eliminated and a different form of charge former is applied. Also, this embodiment employs an arrangement for limiting the amount of boost pressure delivered from the compressor to the engine combustion chambers 44. Aside from these and some other minor differences, which will be described, this embodiment is the same as that previously described and where components or portions of the components are the same as those of the previous embodiment, these components or portions have been identified by the same reference numerals and will be described again only in such detail as is necessary to understand the construction and operation of this embodiment.

In this embodiment, the intake passage 49 for the compressor is somewhat larger so as to accommodate a pressure relief return from the discharge charge, as will be described. An intake manifold 102 cooperates with the induction side of the air compressor and admits the air charge into the crankcase chambers 42.

The discharge side from the crankcase chambers 42 is formed by a separate insert piece 103 that forms a portion of the cylinder block crankcase assembly 32 and which has a single inclined surface 62 as in the previously described embodiment. Formed in this inclined surface are a pair of discharge ports 104 which are axially aligned with a respective one of the crankshaft discs 65 and which have a bifurcated shape as shown best in FIG. 2 or what might be characterized as a siamesed configuration. The opening and closing of these discharge ports 104 is controlled by a pair of recesses 105 formed in the crankshaft disc portions 65 and which operate like a rotary valve, as will become apparent through the description of the operation.

These siamesed discharge passages 104 communicate with an intake manifold 106 in which a charge former such as a carburetor 107 of any known type is positioned. Downstream of the carburetor 107, the manifold 106 has a further delivery runner 108 that extends to the cylinder head intake passage 45.

There is also provided upstream of the charge former or carburetor 107 a pressure relief passage 109 which communicates with the intake passage 49 through an opening 111. A throttle valve 112 is positioned in the relief passage 109 and when closed will permit full boost to be exerted on the system. By opening the valve 112, the amount of boost can be controlled or limited. Basically, the valve 112 is opened when the engine is running at low speeds and low loads and not much boost pressure is desired and is closed as the speed and load increase. Alternatively, a pressure sensing mechanism may be employed for opening and closing the relief valve 112.

Figure 19:
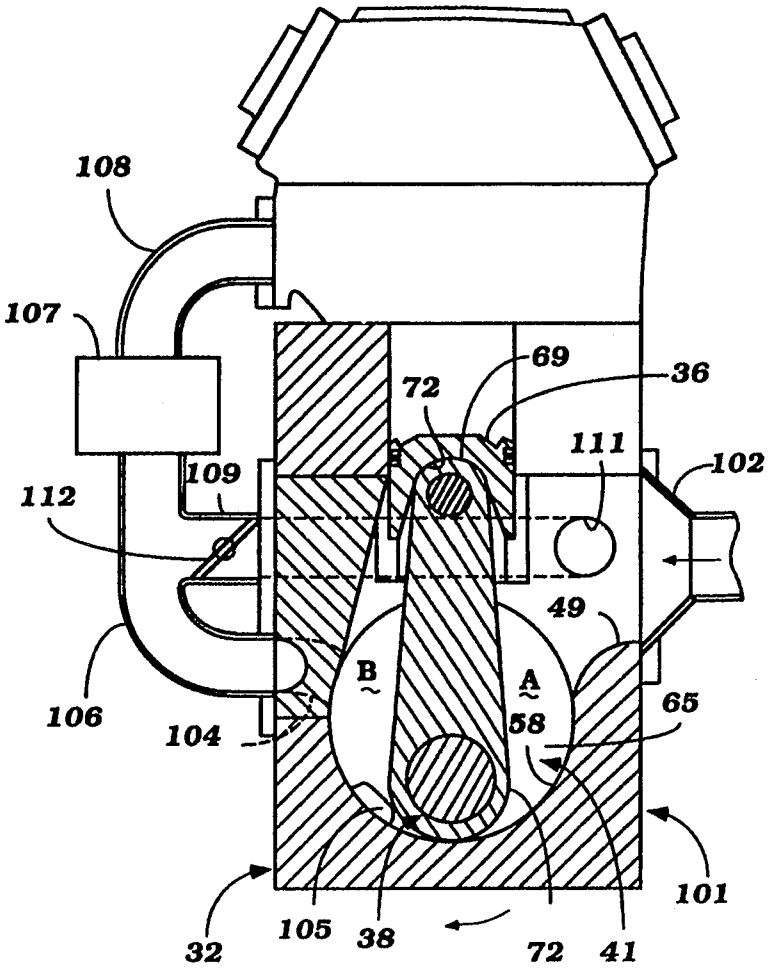
FIGS. 19 through 26 are sequential views of this embodiment, in part similar to FIGS. 7 through 13 and show the various conditions during a single rotation of the crankshaft at the following angular positions.
Figure 20:
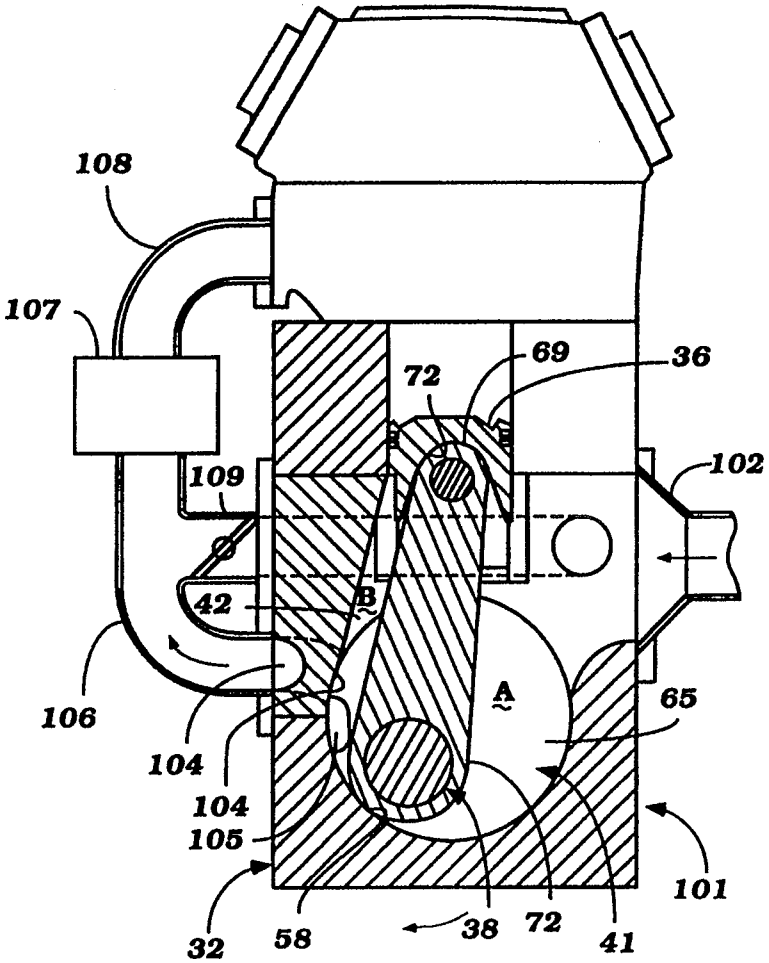

Operation of this embodiment will now be described by reference to FIGS. 19 through 26 which show the condition during a single rotation of the crankshaft 41. Again, the operation is described beginning at bottom dead center as shown in FIG. 19 wherein the connecting rod surface 72 is in engagement with the cylindrical surface 58 of the crankcase 34 and thus divides the crankcase into two chambers as aforedescribed. In this position, there will have already been some compression of the charge on the exhaust side of the connecting rod 38, but since the discs portions 65 of the crankshaft 41 will be obscuring or closing the discharge ports 104 this will merely result in a pressure rise in the crankcase chamber portion B.

Figure 21:
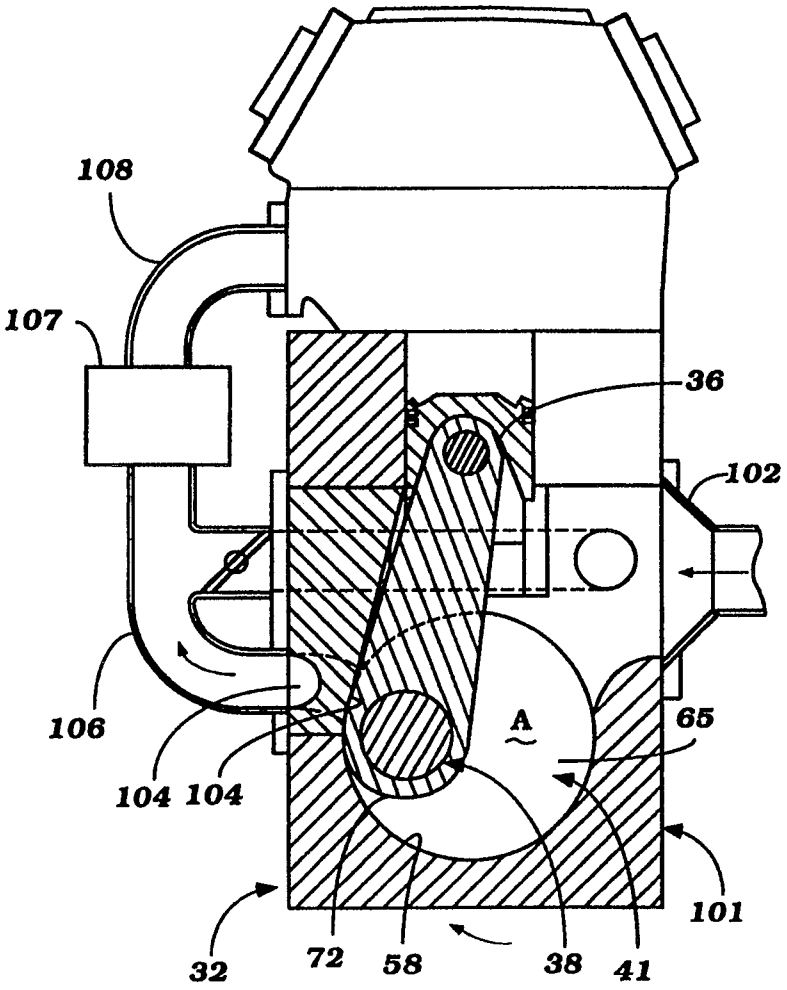

As the rotation continues to the position shown in FIG. 21, charge will still be drawn into the inlet chamber and compressed in the exhaust chamber. However, the crankshaft recesses or valve openings 105 will now come into registry with the discharge ports 104 and the compressed charge can flow into the manifold 106 for delivery to the charge former 107 and flow into the intake passage 45 of the cylinder head at such time as the intake valve 46 is opened. Until the intake valve 46 opens the charge pressure will be built up in the manifold 106 assuming the pressure relief valve 112 is not opened.

Figure 22:
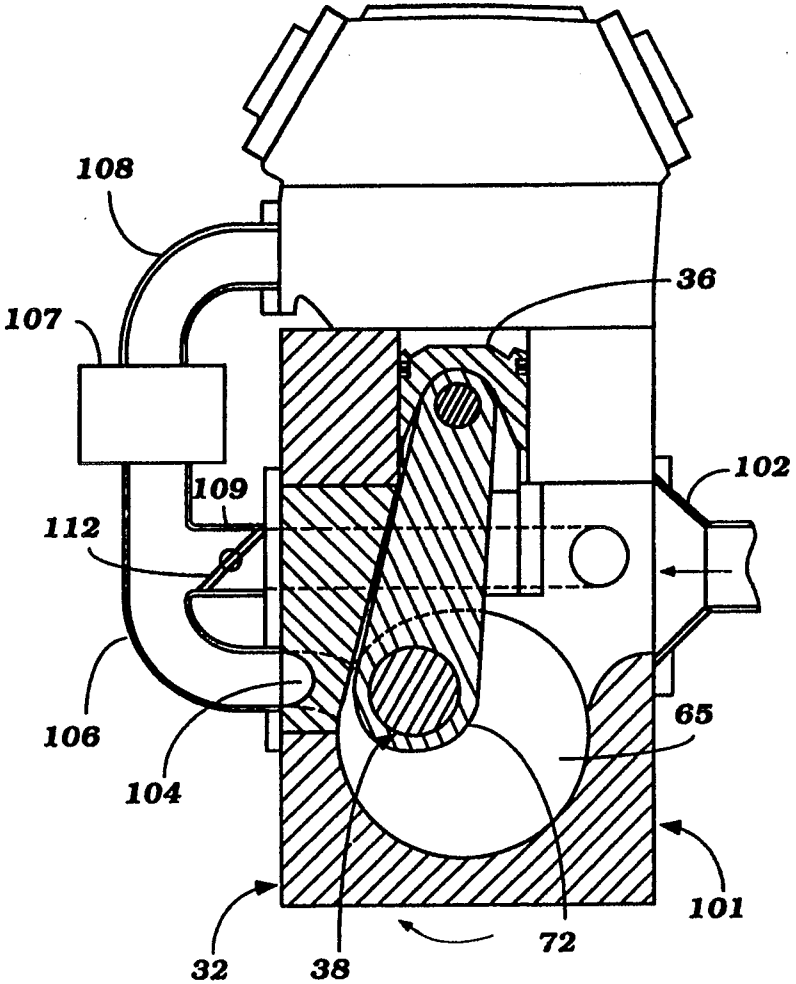
Figure 23:
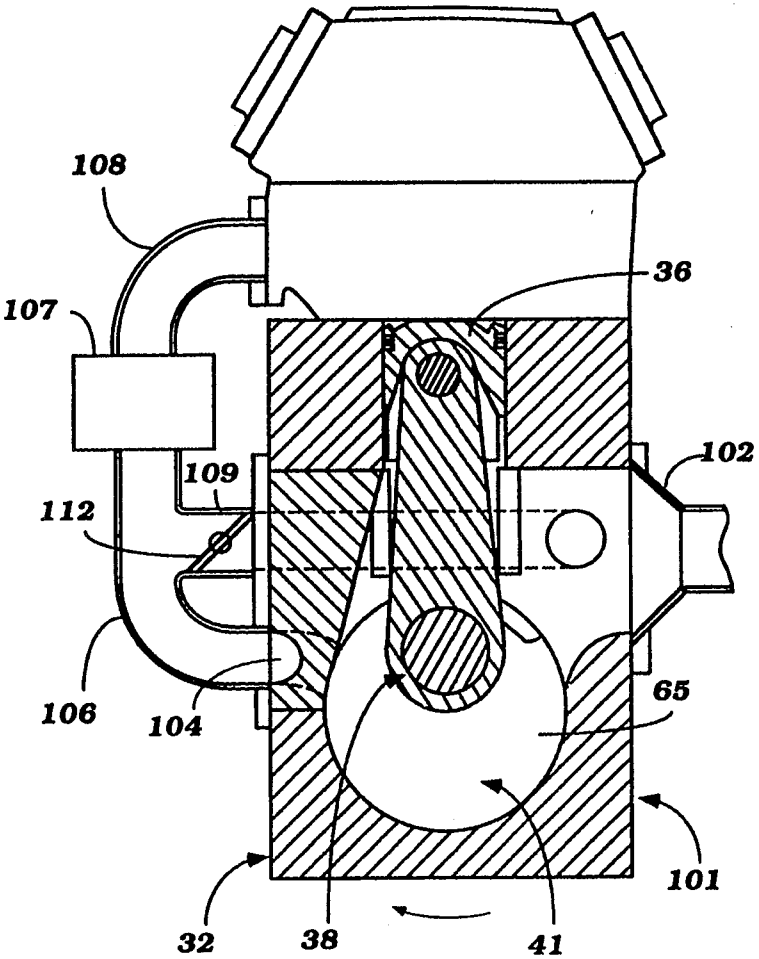

As the piston 36 approaches top dead center position, the crankshaft recesses 105 will again come out of registry of the discharge ports 104 and the flow will begin to be cut off as shown in FIG. 21 and completely stopped as shown in FIG. 22. At this time, any pressure which may have been built up on the manifold 106 due to closure of the intake valves 46 will be maintained. Assuming the engine is on the exhaust stroke and the intake valve opens sometime when the piston 36 is moving between the position shown in FIG. 21 and FIG. 22, flow will occur through the charger former 107 and into the combustion chambers 44. The timing of opening of the intake valve 46 may be appropriately designed as is well known to those skilled in the art.

Figure 24:
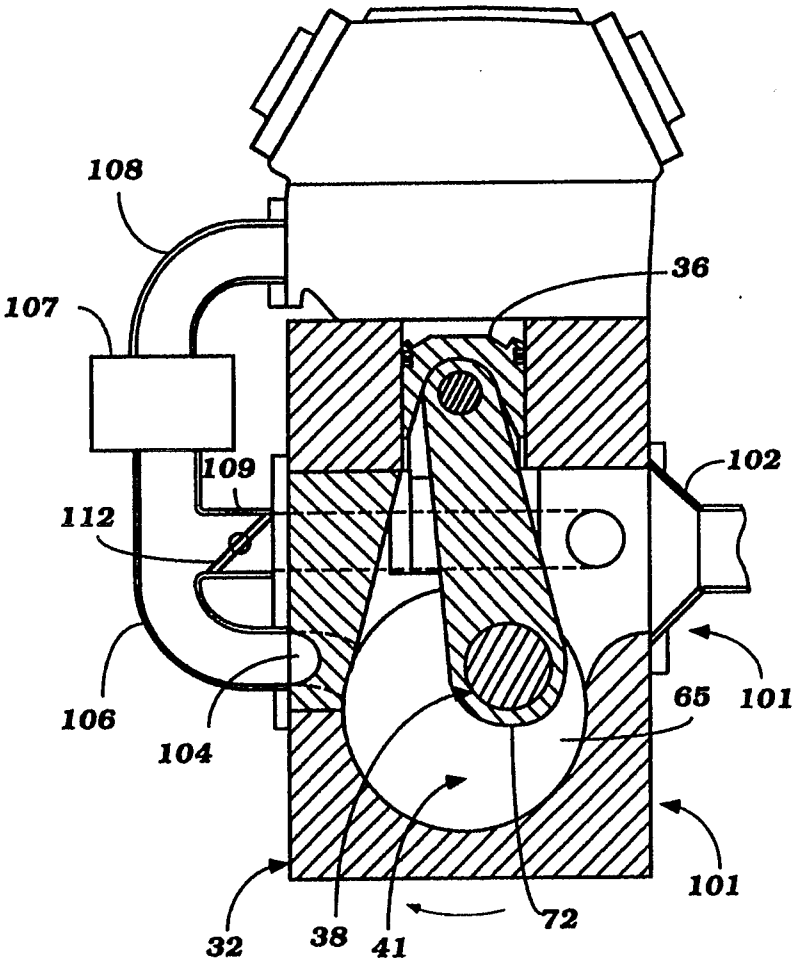
Figure 25:
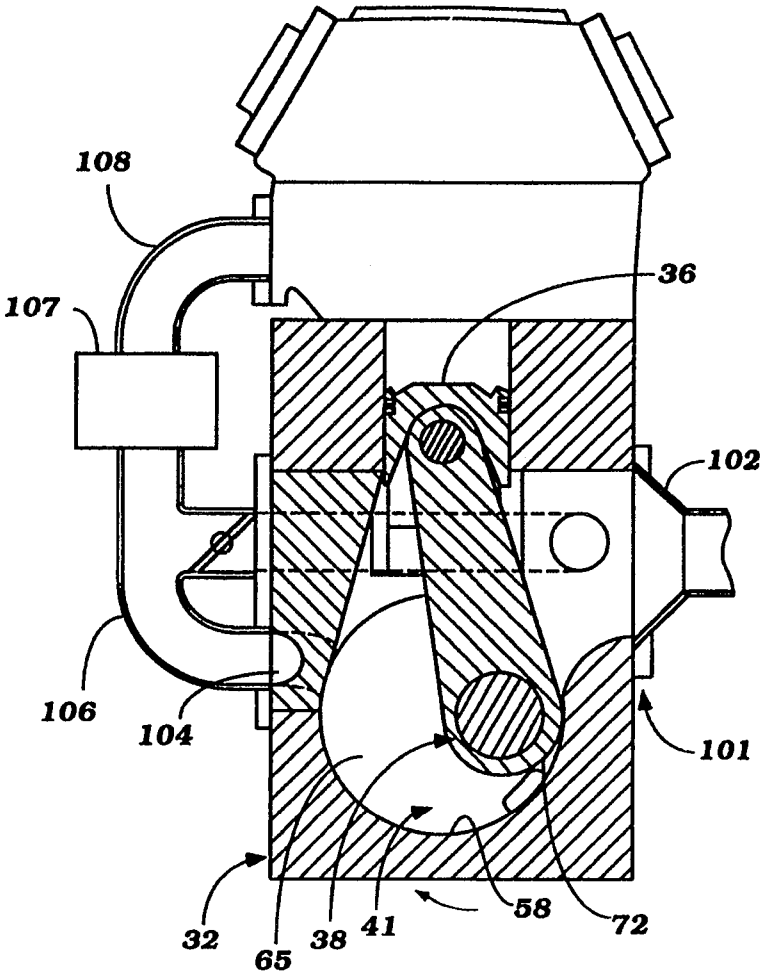
Figure 26:
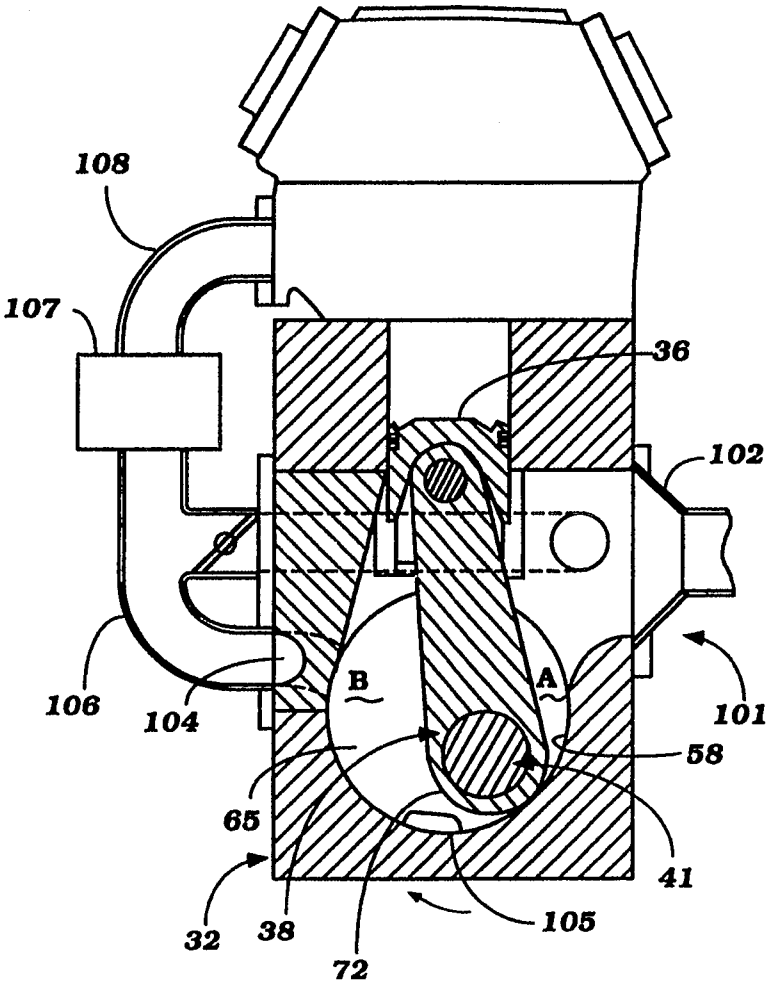

Once the piston 36 moves to the position shown in FIG. 22, the isolation between the two crankcase chamber portions will cease and intake charge can continue to be drawn into the chamber of the crankcase. This continues as the piston 23 moves to top dead center and past it to the condition as shown in FIGS. 24 and 25 at which time the intake passage 49 will be closed off as previously described and the connecting rod surface 72 will again then isolate the two chambers A and B as shown in FIG. 25 and permit continued compression on the discharge side as shown in FIG. 26. Since the operation of the compressor phase is substantially the same as that previously described, it is believed that further description of this operation will be unnecessary as the operation will be obvious to those skilled in the art.

Thus, it should be readily apparent from the described construction that a very effective compressor for the crankcase of a reciprocating machine is provided by both embodiments and one or both of the reed type check valves normally required can be eliminated. Of course, the foregoing description is that of preferred embodiments of the invention and various changes and modifications may be made without departing from the spirit and scope of the invention, as defined by the appended claims. For example, although the invention has been described in conjunction with a crankshaft which has bearing portions at both sides, it should be readily apparent that either bearing portion 64 could be eliminated to provide a cantilevered construction.

I claim:

1. A reciprocating machine comprised of a cylinder having a cylinder bore with a crankcase chamber formed at one end thereof, a piston reciprocating in said cylinder bore, a crankshaft rotatably journalled in said crankcase chamber, a connecting rod coupled to said piston and said crankshaft for transmitting motion therebetween, means for providing a seal between one end of said connecting rod and said piston and between the sides of said connecting rod and the side surfaces of said crankcase chamber, said connecting rod having a portion thereof in sealing engagement with said crankcase during at least a portion of a single rotation of said crankshaft for dividing said crankcase chamber into a pair of variable volume chambers formed solely by said piston, said cylinder bore, said connecting rod, said crankshaft and said crankcase chamber for acting as a positive displacement pump having two pumping cycles per each revolution of the crankshaft, intake means for admitting an air charge to said crankcase chamber, and exhaust means for discharging a compressed air charge from said crankcase chamber.

2. A reciprocating machine as set forth in claim 1 wherein the means for admitting the air charge to the crankcase chamber comprises an intake port disposed on one side of said crankcase chamber and the means for discharging a compressed charge from the crankcase chamber comprises a discharge port disposed on the other side of said crankcase chamber.

3. A reciprocating machine as set forth in claim 2 wherein at least one of the connecting rod and the crankshaft acts as a valve element for opening and closing one of said ports.

4. A reciprocating machine as set forth in claim 3 wherein the other of the connecting rod and the crankshaft comprises means for controlling the opening of the other of the ports.

5. A reciprocating machine as set forth in claim 4 wherein the connecting rod controls the opening and closing of the intake port and the crankshaft controls the opening and closing of the discharge port.

6. A reciprocating machine as set forth in claim 3 wherein the one of the crankshaft and connecting rod comprises the connecting rod.

7. A reciprocating machine as set forth in claim 6 wherein the connecting rod controls the opening of the intake port.

8. A reciprocating machine as set forth in claim 3 wherein the one of the connecting rod and crankshaft comprises the crankshaft.

9. A reciprocating machine as set forth in claim 8 wherein the crankshaft controls the opening of the discharge port.

10. A reciprocating machine as set forth in claim 2 wherein the crankcase is defined in part by a cylindrical surface and one end of the connecting rod has a curved surface in sealing engagement with said cylindrical surface during a portion of the rotation of the crankshaft.

11. A reciprocating machine as set forth in claim 10 wherein the other end of the connecting rod has a curved surface in constant sealing engagement with a complimentary curved surface of the piston for providing the seal between said piston and said connecting rod.

12. A reciprocating machine as set forth in claim 11 wherein the crankshaft has a pair of facing sealing surfaces in sealing engagement with opposite sides of the connecting rod through out the rotation of the crankshaft for providing at least in part the seal between said connecting rod and said crankcase chamber.

13. A reciprocating machine as set forth in claim 12 wherein the sealing surfaces of the crankshaft are comprised of cylindrical sections at least one of which has a recess for opening and closing at least one of the ports.

14. A reciprocating machine as set forth in claim 13 wherein the crankshaft recess opens and closes the discharge port.

15. A reciprocating machine as set forth in claim 10 wherein the connecting rod has a surface that acts as a valve for opening and closing one of the ports.

16. A reciprocating machine as set forth in claim 15 wherein the port opened and closed by the connecting rod surface comprises the intake port.

17. A reciprocating machine as set forth in claim 16 wherein the other end of the connecting rod has a curved surface in constant sealing engagement with a complimentary curved surface of the piston for providing the seal between said piston and said connecting rod.

18. A reciprocating machine as set forth in claim 10 wherein the one end of the connecting rod is disposed between a pair of cylindrical webs of the crankshaft which webs have a sealing engagement with the crankcase chamber at least at the time when the one connecting rod is in sealing engagement with the cylindrical surface of the crankcase chamber.

19. A reciprocating machine as set forth in claim 2 wherein the other end of the connecting rod has a curved surface in constant sealing engagement with a complimentary curved surface of the piston for providing the seal between said connecting rod and said piston.

20. A reciprocating machine as set forth in claim 19 wherein the crankshaft has a pair of facing sealing surfaces in sealing engagement with opposite sides of the connecting rod throughout the rotation of the crankshaft for providing at least in part the seal between said connecting rod and said crankcase chamber.

21. A reciprocating machine as set forth in claim 2 wherein the crankshaft has a pair of facing sealing surfaces in sealing engagement with opposite sides of the connecting rod throughout the rotation of the crankshaft for providing at least in part the seal between said connecting rod and said crankcase chamber.

22. A reciprocating machine as set forth in claim 2 further including an accumulator chamber to which the charge compressed in the crankcase chamber is delivered by the discharge port.

23. A reciprocating machine as set forth in claim 2 further including a bypass passage extending from the discharge port to the intake port and valve means in said bypass passage for controlling the pressure of the charge delivered from the discharge port.

24. A reciprocating machine as set forth in claim 1, wherein the means of providing the seal between the one end of the connecting rod and the piston and the sides of said connecting rod and the side surfaces of the crankcase chamber comprising closely fitting surfaces of the connecting rod, piston and crankcase chamber side surfaces.

25. A reciprocating machine as set forth in claim 1 further including means for closing the end of the cylinder bore opposite to the crankcase chamber and forming a piston chamber.

26. A reciprocating machine as set forth in claim 25 wherein the charge compressed in the crankcase is delivered to the piston chamber.

27. A reciprocating machine as set forth in claim 26 further including valve means for controlling the flow of the compressed charge from the crankcase chamber to the piston chamber.

28. A reciprocating machine as set forth in claim 27 wherein there are provided means for opening the valve means only during every second revolution of the crankshaft.

29. A reciprocating machine as set forth in claim 25 wherein the reciprocating machine comprises an internal combustion engine and a combustible charge is burned in the piston chamber.

30. A reciprocating machine as set forth in claim 29 wherein the charge compressed in the crankcase is delivered to the piston chamber.

31. A reciprocating machine as set forth in claim 30 further including valve means for controlling the flow of the compressed charge from the crankcase chamber to the piston chamber.

32. A reciprocating machine as set forth in claim 31 wherein there are provided means for opening the valve means only during every second revolution of the crankshaft.

33. A reciprocating machine as set forth in claim 32 wherein an accumulator chamber is provided to which the charge compressed in the crankcase chamber is delivered by the discharge port and which supplies the compressed charge through the valve means to the piston chamber.

34. A reciprocating machine as set forth in claim 33 wherein the valve means communicates with the accumulator chamber through a trumpet section.

35. A port control arrangement for a reciprocating machine comprised of a cylinder defining a cylinder bore, a piston supported for reciprocating in said cylinder bore, a crankcase chamber formed at open end of said cylinder bore, a crankshaft journalled for rotation in said crankcase chamber, a connecting rod connected at one end to said piston and journalled at the other end on said crankshaft for transmitting motion between said crankshaft and said piston, and means defining a pair of spaced apart ports in said crankcase chamber, one of said connecting rod and said crankshaft being configured for selectively opening and closing the communication of one of said ports with said crankcase chamber upon the rotation of said crankshaft, the other of said connecting rod and crankshaft being configured for opening and closing the communication of the other of said ports with said crankcase chamber upon rotation of said crankshaft.

36. A port control arrangement as set forth in claim 35 wherein the port are formed in a sidewall of the crankcase chamber.

37. A port control arrangement as set forth in claim 36 wherein the connecting rod has a side portion for opening and closing of the one port.

38. A port control arrangement as set forth in claim 36 wherein the crankshaft has a cylindrical portion with a recess and the recess functions to open and close the other port.

39. A reciprocating machine comprised of a cylinder having a cylinder bore with a crankcase chamber formed at one end thereof, a piston reciprocating in said cylinder bore, a crankshaft rotatably journalled in said crankcase chamber, a connecting rod coupled to said piston and said crankshaft for transmitting motion therebetween, said connecting rod having a portion thereof in sealing engagement with said crankcase during at least a portion of a single rotation of said crankshaft for acting as a positive displacement pump, intake means for admitting an air charge to said crankcase chamber comprising an intake port disposed on one side of said crankcase chamber, exhaust means for discharging a compressed air charge from said crankcase chamber comprising a discharge port disposed on the other side of said crankcase chamber, at least one of said connecting rod and said crankshaft acting as a valve element for opening and closing one of said ports and the other of said connecting rod and said crankshaft comprising means for controlling the opening of the other of the ports.

40. A reciprocating machine as set forth in claim 39 wherein the one of the crankshaft and connecting rod comprises the connecting rod.

41. A reciprocating machine as set forth in claim 40 wherein the connecting rod controls the opening of the intake port.

42. A reciprocating machine comprised of a cylinder having a cylinder bore with a crankcase chamber formed at one end thereof, a piston reciprocating in said cylinder bore, a crankshaft rotatably journalled in said crankcase chamber, a connecting rod coupled to said piston and said crankshaft for transmitting motion therebetween, said connecting rod having a portion thereof in sealing engagement with said crankcase during at least a portion of a single rotation of said crankcase for acting as a positive displacement pump, intake means for admitting an air charge to said crankcase chamber, comprising an intake port disposed on one side of said crankcase chamber, and exhaust means for discharging a compressed air charge from said crankcase chamber comprising a discharge port disposed on the other side of said crankcase chamber, said crankshaft acting as a valve element for opening and closing one of said ports.

43. A reciprocating machine as set forth in claim 42 wherein the crankshaft controls the opening of the discharge port.

44. A reciprocating machine as set forth in claim 39 wherein the connecting rod controls the opening and closing of the intake port and the crankshaft controls the opening and closing of the discharge port.

45. A reciprocating machine comprised of a cylinder having a cylinder bore with a crankcase chamber formed at one end thereof, a piston reciprocating in said cylinder bore, a crankshaft rotatably journalled in said crankcase chamber, a connecting rod coupled to said piston and said crankshaft for transmitting motion therebetween, said connecting rod having a portion thereof in sealing engagement with said crankcase during at least a portion of a single rotation of said crankshaft for acting as a positive displacement pump, intake means for admitting an air charge to said crankcase chamber comprising an intake port disposed on one side of said crankcase chamber, and exhaust means for discharging a compressed air charge from said crankcase chamber comprising a discharge port disposed on the other side of said crankcase chamber, said crankcase chamber being defined in part by a cylindrical surface, one end of said connecting rod having a curved surface in sealing engagement with said cylindrical surface during a portion of the rotation of the crankshaft, the other end of said connecting rod having a curved surface in constant sealing engagement with a complimentary curved surface of said piston, said crankshaft having a pair of facing sealing surfaces in sealing engagement with opposite sides of said connecting rod through out the rotation of said crankshaft, said sealing surfaces of said crankshaft being comprised of cylindrical sections at least one of which has a recess for opening and closing at least one of said ports.

46. A reciprocating machine as set forth in claim 45 wherein the crankshaft recess opens and closes the discharge port.

47. A reciprocating machine comprised of a cylinder having a cylinder bore with a crankcase chamber formed at one end thereof, a piston reciprocating in said cylinder bore, a crankshaft rotatably journalled in said crankcase chamber, a connecting rod coupled to said piston and said crankshaft for transmitting motion therebetween, said connecting rod having a portion thereof in sealing engagement with said crankcase during at least a portion of a single rotation of said crankshaft for acting as a positive displacement pump, intake means for admitting an air charge to said crankcase chamber comprising, an intake port disposed on one side of said crankcase chamber and exhaust means for discharging a compressed air charge from said crankcase chamber comprising a discharge port disposed on the other side of said crankcase chamber said crankshaft having a pair of facing sealing surfaces in sealing engagement with opposite sides of said connecting rod throughout the rotation of said crankshaft.

48. A reciprocating machine comprised of a cylinder having a cylinder bore with a crankcase chamber formed at one end thereof, a piston reciprocating in said cylinder bore, a crankshaft rotatably journalled in said crankcase chamber, a connecting rod coupled to said piston and said crankshaft for transmitting motion therebetween, said connecting rod having a portion thereof in sealing engagement with said crankcase during at least a portion of a single rotation of said crankshaft for acting as a positive displacement pump, intake means for admitting air charge to said crankcase chamber comprising an intake port disposed on one side of said crankcase chamber, exhaust means for discharging a compressed air charge from said crankcase chamber comprising a discharge port disposed on the other side of said crankcase chamber, a bypass passage extending from the discharge port to the intake port and valve means in said bypass passage for controlling the pressure of the charge delivered from the discharge port.

* * * * *